US009526672B2

(12) United States Patent
Kownacki et al.

(10) Patent No.: US 9,526,672 B2
(45) **Date of Patent: *Dec. 27, 2016**

(54) JET FITTINGS FOR BATHING INSTALLATIONS

(71) Applicant: Balboa Water Group, Inc., Tustin, CA (US)

(72) Inventors: Eric J. Kownacki, Rancho Bernardo, CA (US); Graham J. Campbell, Stevenson Ranch, CA (US)

(73) Assignee: Balboa Water Group, Inc., Tustin, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/592,303

(22) Filed: Jan. 8, 2015

(65) Prior Publication Data

US 2015/0150757 A1 Jun. 4, 2015

Related U.S. Application Data

(63) Continuation-in-part of application No. 13/858,842, filed on Apr. 8, 2013, now Pat. No. 9,066,635, which is a continuation-in-part of application No. 13/564,657, filed on Aug. 1, 2012, now Pat. No. 9,066,634.

(60) Provisional application No. 61/925,616, filed on Jan. 9, 2014.

(51) Int. Cl.

| | |
|---|---|
| ***A61H 33/04*** | (2006.01) |
| ***A61H 33/00*** | (2006.01) |
| ***A61H 33/02*** | (2006.01) |
| ***E03C 1/048*** | (2006.01) |

(52) U.S. Cl.

CPC ..... *A61H 33/6063* (2013.01); *A61H 33/026* (2013.01); *E03C 1/048* (2013.01); *A61H 33/6005* (2013.01); *A61H 2033/023* (2013.01)

(58) Field of Classification Search

CPC ..... A61H 33/6063
USPC ..... 4/541.1–541.6
See application file for complete search history.

(56) References Cited

U.S. PATENT DOCUMENTS

2002/0062520 A1* 5/2002 Castellote ..... A61H 33/026 4/541.5

* cited by examiner

*Primary Examiner* — Christine Skubinna
(74) *Attorney, Agent, or Firm* — Larry K. Roberts

(57) ABSTRACT

A fitting for a bathing installation includes a body portion defining a hollow main body portion having an interior opening, and a connection portion having a passageway in communication with the interior opening. The connection portion includes at least one connection port for attachment to a hose carrying pressurized water, and a flange portion defining a recessed mount surface inside a peripheral lip surrounding a recess. Open regions are defined in the peripheral lip. A nozzle member is fitted into the interior opening and has a nozzle orifice configured for concentric mounting relative to a hole formed in the wall of the vessel to allow pressurized air or water to pass from the connection port through the central opening and through the nozzle orifice into the tub hole and into the interior of the vessel.

20 Claims, 20 Drawing Sheets

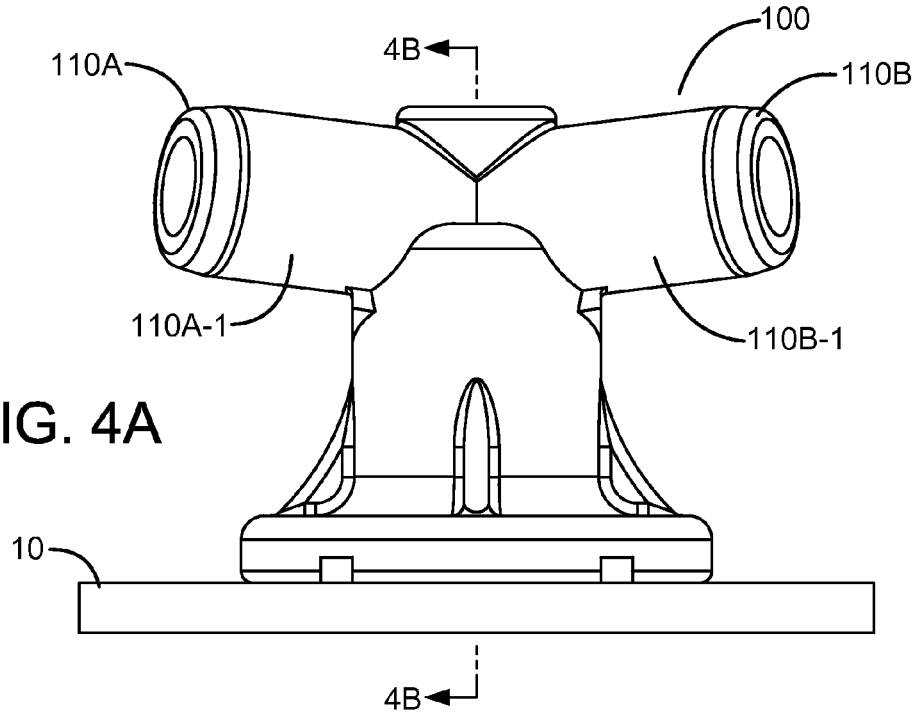
FIG. 4A
FIG. 4B
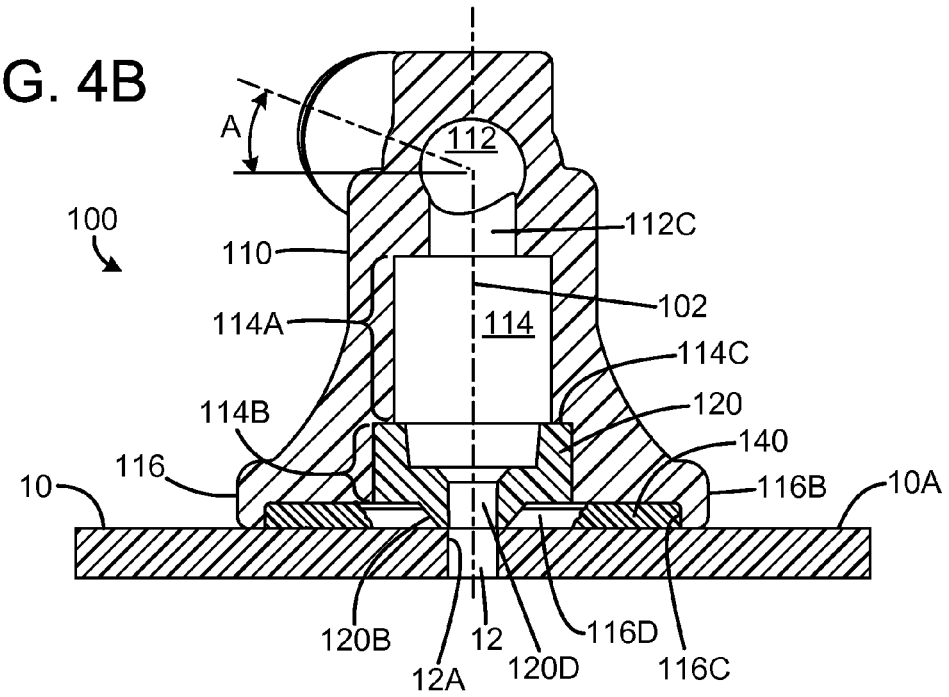

FIG. 12
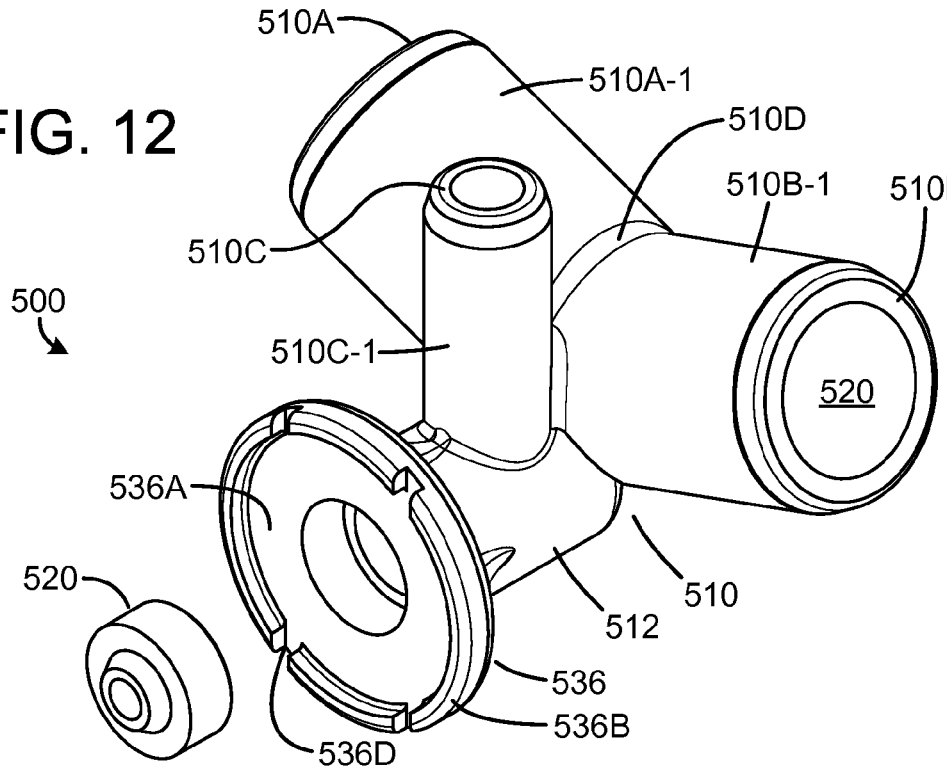
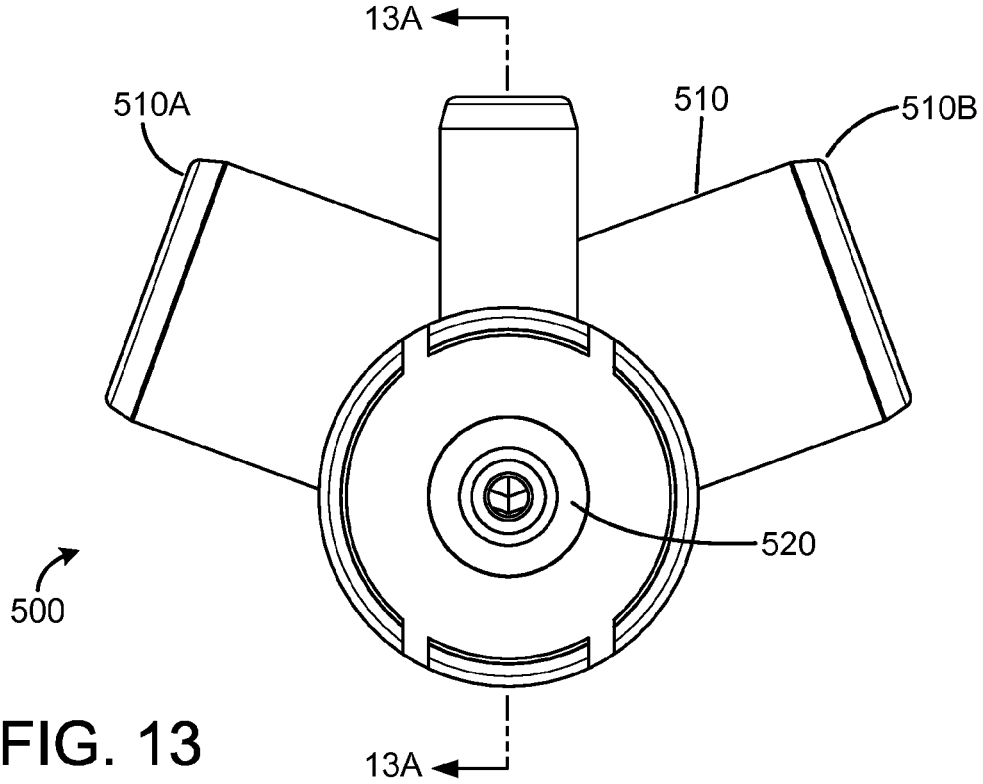
FIG. 13

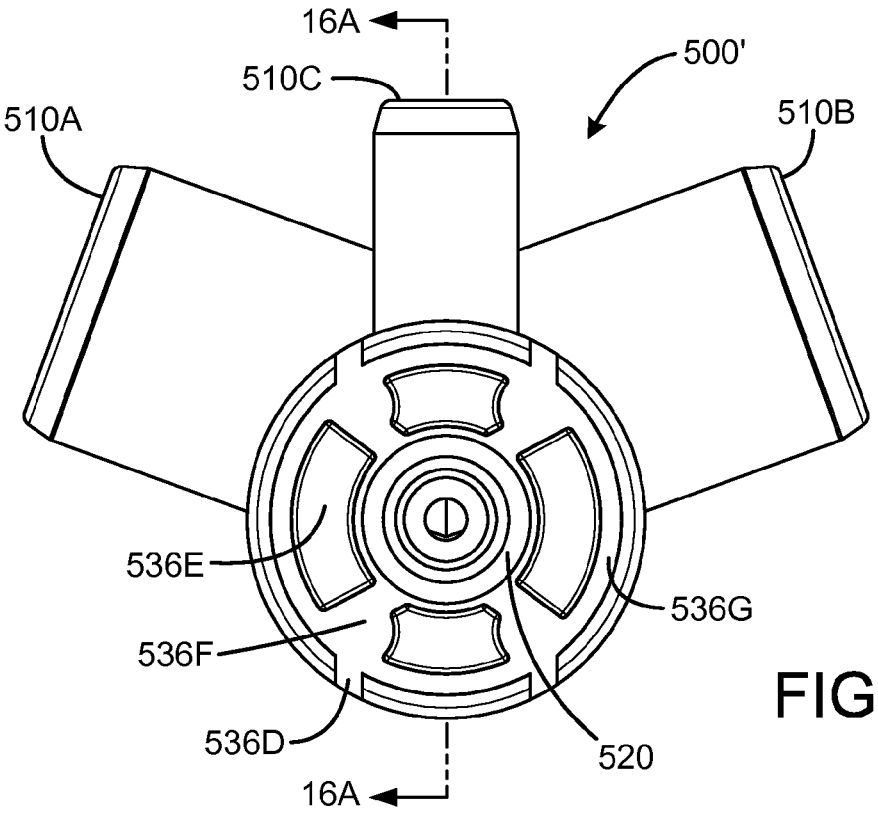
FIG. 16
FIG. 16A
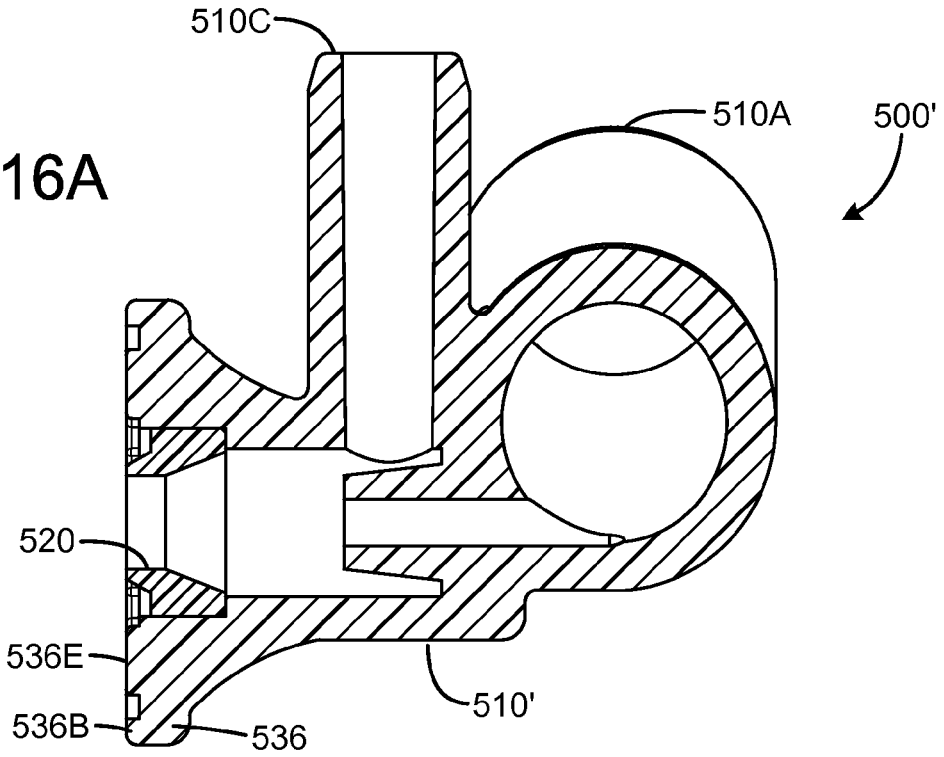

JET FITTINGS FOR BATHING INSTALLATIONS

CROSS-REFERENCE TO RELATED PATENT APPLICATIONS

This application claims priority to U.S. Provisional Patent Application 61/925,616, filed Jan. 9, 2014, and is a continuation-in-part of U.S. patent application Ser. No. 13/858,842, filed Apr. 8, 2013, which is a continuation-in-part of U.S. patent application Ser. No. 13/564,657, filed Aug. 1, 2012, the entire contents of which applications are incorporated herein by reference.

BACKGROUND

Bathing installations such as bath tubs, whirlpool baths, and spas may utilize air jets to deliver pressurized air into the bathing water in a bathing installation vessel. The installation of air jets to a vessel presents difficulties in attachment to the vessel, and connection of the air jets to a source of pressurized air. Similarly, water jets present attachment difficulties as well as other difficulties including drainage of water from water lines and the jets.

BRIEF DESCRIPTION OF THE DRAWINGS

Features and advantages of the disclosure will readily be appreciated by persons skilled in the art from the following detailed description when read in conjunction with the drawing wherein:

FIG. 4A is a front plan view of the air fitting of FIG. 3, positioned on a representation of a tub wall of a bathing installation. FIG. 4B is a cross-sectional view of the air fitting and tub wall as shown in FIG. 4A, taken along line 4B-4B.

FIG. 12 is an isometric view of a further exemplary embodiment of a fitting for a bathing installation, providing a water jet feature.

FIG. 13 is a front view of the fitting of FIG. 12.

FIG. 16 is a front view of the fitting of FIG. 15.

FIG. 16A is a cross-sectional view of the fitting of FIGS. 15 and 16, taken alone line 16A-16A of FIG. 16.

DETAILED DESCRIPTION

Figure 1A:
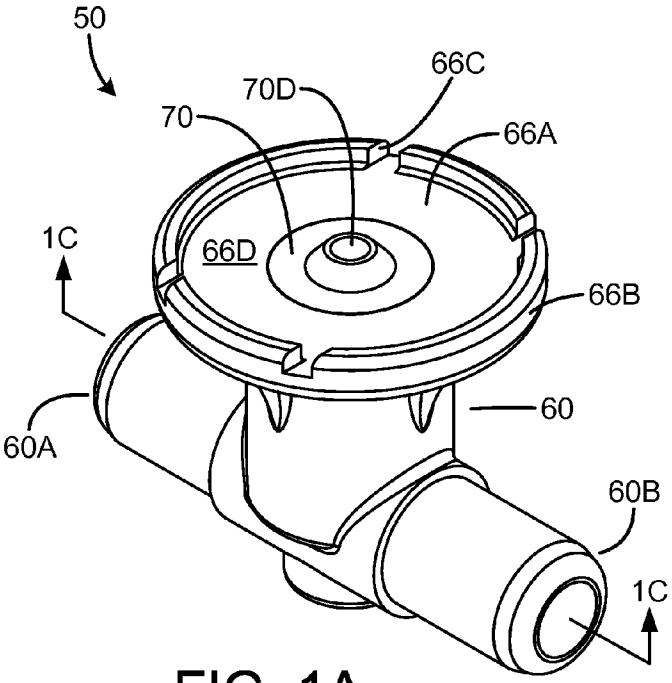
FIG. 1A is an isometric view of an exemplary embodiment of an air fitting for a bathing installation.

In the following detailed description and in the several figures of the drawing, like elements are identified with like reference numerals.

Exemplary embodiments of air jets for bathing installations are described. The air jets may serve as air massage jets for the bathing installation. In an exemplary embodiment, the air jet mounts to the outside surface of the bath shell or tub. The exemplary embodiments may include one or more of the following features:

(1) The air jet provides a stealth or minimalistic look to the inside of the bathing installation tub.

2) Air exits the air jet into the bath by a small hole drilled through the shell of the bath concentric with an air exit orifice in the jet.

3) The air jet is configured to mount to the vertical sides of the bath tub or beneath the floor of the tub.

4) The air jet can be used with or without an internal check valve or one way flow valve.

5) The air jet connection for attachment to an air hose may be smooth, barbed or socket-type connections, for example. For a smooth and a barbed connection, the hose end is slid over the outer surface of the air jet connecting port. For a socket-type connection, a socket connection is fitted inside the air jet connecting portion.

6) The connection(s) for air hose(s) may be in an "L" or "T" shape.

7) The connection for the air hose ("L" or "T") may also be angled or compound angled thus appearing in a "V" type or broken wing appearance, and may provide one or more of the following features:

a. The angle or compound angle when mounted to the side of the bath and pointed upward creates a self-draining effect through each individual jet (no check valve required). This permits jets to be placed at different elevations and still drain. Conventional jets instead need to be in a straight line daisy chain for jets to drain.

b. The angle, besides promoting drainage, makes installation of the tubing between jets easier when placed close together. Conventional jets with straight 180 degree connection have very little space between them to try to install the tubing.

c. The compound angle also moves the ends of the tube connections and tubing farther away from the tub shell creating more clearance for fingers to promote ease of tubing installation.

8) The air jet may be provided to the customer as a single piece construction, without requiring threaded multi-piece end flanges or threaded bodies to assemble with annular seals.

9) Slots may be provided around a recessed mounting lip to allow excess adhesive or glue to exit and not block the hole for airflow in the tip of the body.

10) Air exits through a protruding nozzle tip on the mounting surface of the air jet that is at the same height or plane with the outer lip of the mounting surface, in one exemplary embodiment. This keeps adhesive or glue from entering the air exit orifice.

11) A protruding nozzle tip may be provided around the air exit orifice which protrudes past the plane described by the outer lip of the mounting surface, in another embodiment. This protruding nozzle tip can extend into a recess or chamfer around the tub shell hole in the back side of the tub shell for ease of installation and to keep adhesive or glue from entering the air exit orifice.

12) The air jet may be installed in the following set of steps:

a. Drill a small diameter hole through the tub shell.

b. Adhesive or glue is applied in the area between the protruding nozzle tip and the slotted perimeter mounting lip and when pushed against the tub shell the excess adhesive or glue exits the slots in the perimeter lip of the mounting flange.

c. The alignment of the air jet nozzle orifice in the jet and the hole in the tub shell can be facilitated by several techniques, such as a pin guide placed through the hole in the tub shell, or magnets aligning the air jet with a fixture on the inside of the tub shell. Another alternative is to extend the air jet nozzle tip to protrude beyond the plane described by the outer lip of the mounting surface. This protruding nozzle can fit into a recess or hole chamfer drilled on the backside of the tub shell to easily locate the hole in the tub shell with the air exit orifice.

13) The air jet can be installed on a bath as an air massage system only or in conjunction with a hydrotherapy system utilizing water jets.

14) An air massage system includes a source for positive air pressure that is sent through a plumbing system and hose to arrive at the air jet hose connection and passes thought the air jet exiting through the orifice and then through the hole in the tub shell into the bath. If an internal check valve is in the air jet, the air pressure must be sufficient open the check valve to have the air exit the orifice and through the wall in the side of the tub.

15) The internal air check valve prevents water from back flowing into the air jet and plumbing keeping the plumbing system "dry". This permits the air to flow into the bath more quickly when the system is initiated since there is no water to evacuate from the plumbing. The check valve also keeps water from remaining in the lines, preventing any retained water.

Figure 1B:
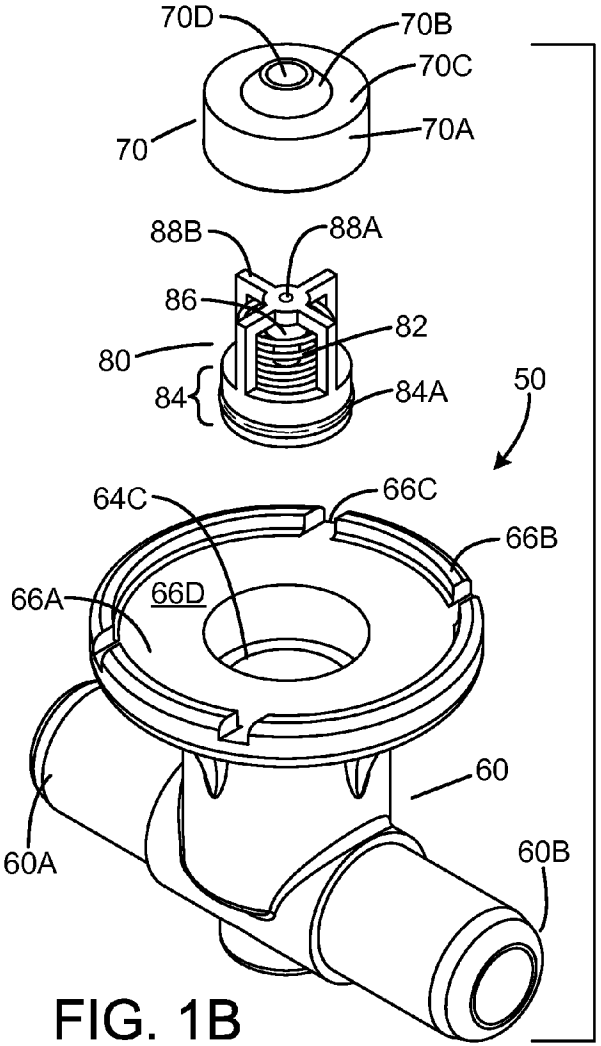
FIG. 1B is an exploded isometric view of the air fitting of FIG. 1A.
Figure 1C:
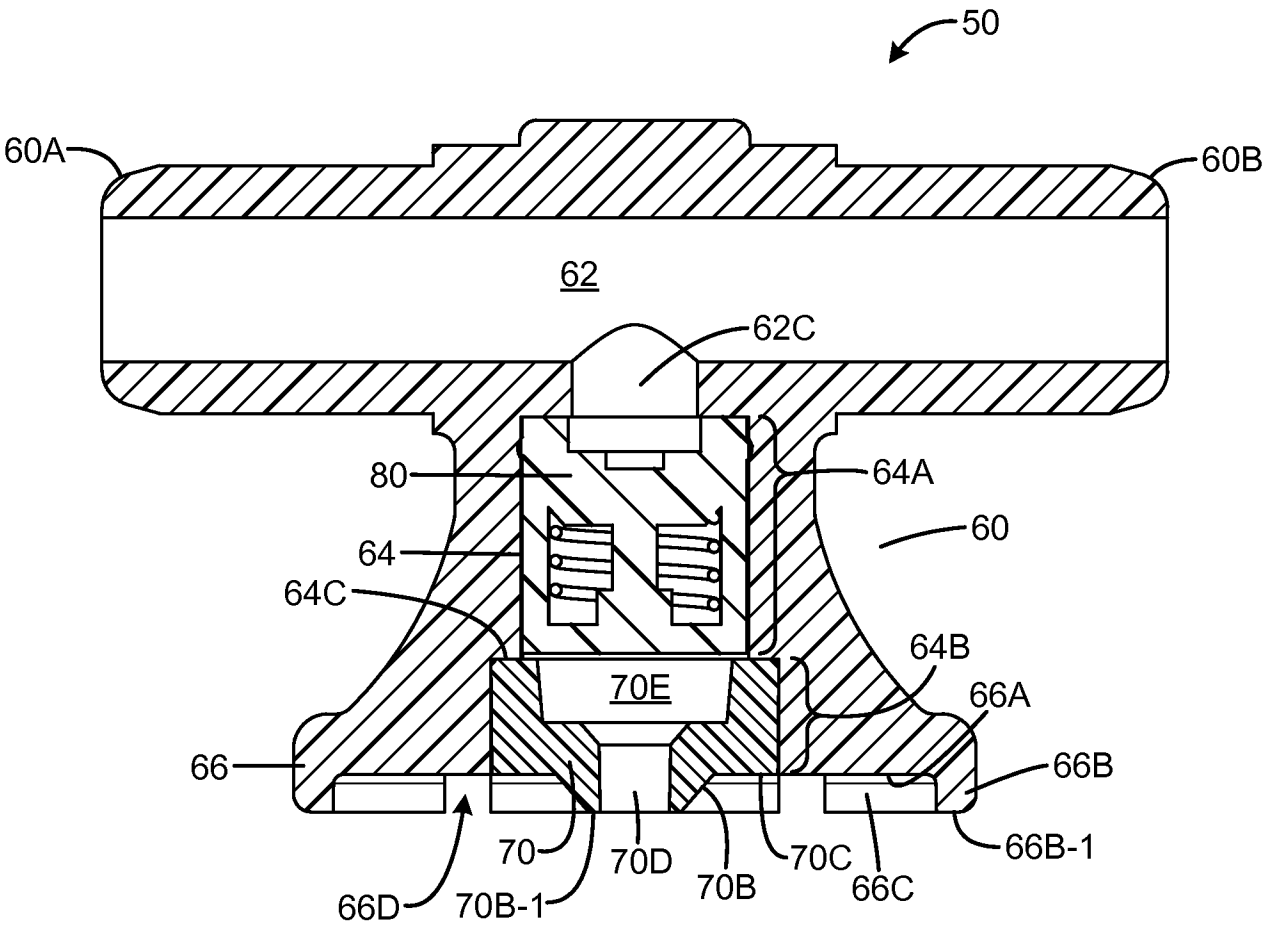
FIG. 1C is a cross-section view of the air fitting of FIG. 1A, taken along line 1C-1C.

The figures illustrate several embodiments of an air jet incorporating one or more of the features described above. FIGS. 1A-1C illustrate a first embodiment of an air jet 50. The air jet includes a jet body structure 60, a jet nozzle structure 70 and a one way flow valve 80. For some applications, the one way flow valve may be omitted. In this exemplary embodiment, the air jet provides a straight T configuration, with air connection portions 60A and 60B connected to an air passageway 62. Air hoses may be connected to the respective air connection portions. The passageway 62 is in fluid communication with an air jet body opening or cavity 64 through an opening 62C formed in the jet body 60. In an exemplary embodiment, the air passageway 62 has a diameter of ¼ inch, and the connection portions are configured to attach to air hoses having a nominal inner diameter of ⅜ inch.

The body opening 64 in this exemplary embodiment is generally cylindrical with a stepped change in diameter from a first diameter of opening portion 64A to a second, larger diameter of opening portion 64B, to define a shoulder 64C. The valve 80 has an outer diameter sized to fit into the first opening portion 64A, and in this embodiment includes a first valve body portion 84 with an exterior peripheral elastomeric O-ring 84A to provide an interference, sealing fit of the valve into the air jet body. The nozzle 70 and the tub shell wall also serve to maintain the valve 80 in position after installation of the air jet to the tub wall.

The air jet nozzle 70 is fitted into the opening portion 64B of the body 60, and is seated against the shoulder 64C. The nozzle 70 is press fit into engagement with the jet body in an exemplary embodiment. In an exemplary embodiment the nozzle includes a substantially cylindrical portion 70A, with a protruding tapered nozzle tip 70B extending from the surface 70C of the portion 70A. In an exemplary embodiment, the nozzle includes a through opening or orifice 70D passing through the nozzle body, into a nozzle recess opening 70E formed in the interior side of the nozzle 70 when installed in the jet body, to communicate with the body opening 64 of the jet body structure 60 via the one-way flow valve 80. In this exemplary embodiment, the face surface 70B-1 of the nozzle tip 70B is about flush with the edge 66B-1 of the lip portion 66B. In other embodiments, the face surface extends beyond the edge of the lip portion and may serve as a pilot to align to the opening formed through a tub wall, as describe below in further detail.

In an exemplary embodiment, the flow valve 80 is a check valve including a poppet spring 82 which applies a bias force tending to hold a poppet or plunger 86 in a closed position against an inwardly projecting peripheral lip portion or valve seat of the check valve body. When sufficient air pressure is applied to the air jet, the spring 82 is compressed, the air pressure pushing the poppet 86 away from the peripheral lip portion and opening an air channel between the air passageway 62C and the nozzle 70. A stem portion of the poppet 86 is displaced through the opening 88A formed in the web portion 88B of the valve cage portion 88. With air pressure diminished below a valve break pressure, the spring pushes the poppet back into sealing engagement with the peripheral lip portion. One way flow valves suitable for the purpose are commercially available.

The air jet body 60 includes a flange portion 66, defining a recessed mount surface 66A defined inside a peripheral lip 66B at a mounting surface side of the jet body 60, and forming a shallow recess 66C. Slots 66D are defined in the peripheral lip 66B, and allow excess adhesive applied to the mount surface 66A within the recess 66C to escape during installation. Typically the adhesive is a liquid or gel such as an epoxy when applied and then cures to a hardened state.

The air jet body 60 and nozzle 70 may each be fabricated as injection molded parts, from a plastic material, e.g. PVC or ABS. In an exemplary embodiment, the air jet 50 is delivered to a customer/user as an assembled device, i.e. with the nozzle and one-way valve assembled to the jet body, facilitating installation by reducing or eliminating the need to assemble the air jet before installation.

Figure 2:
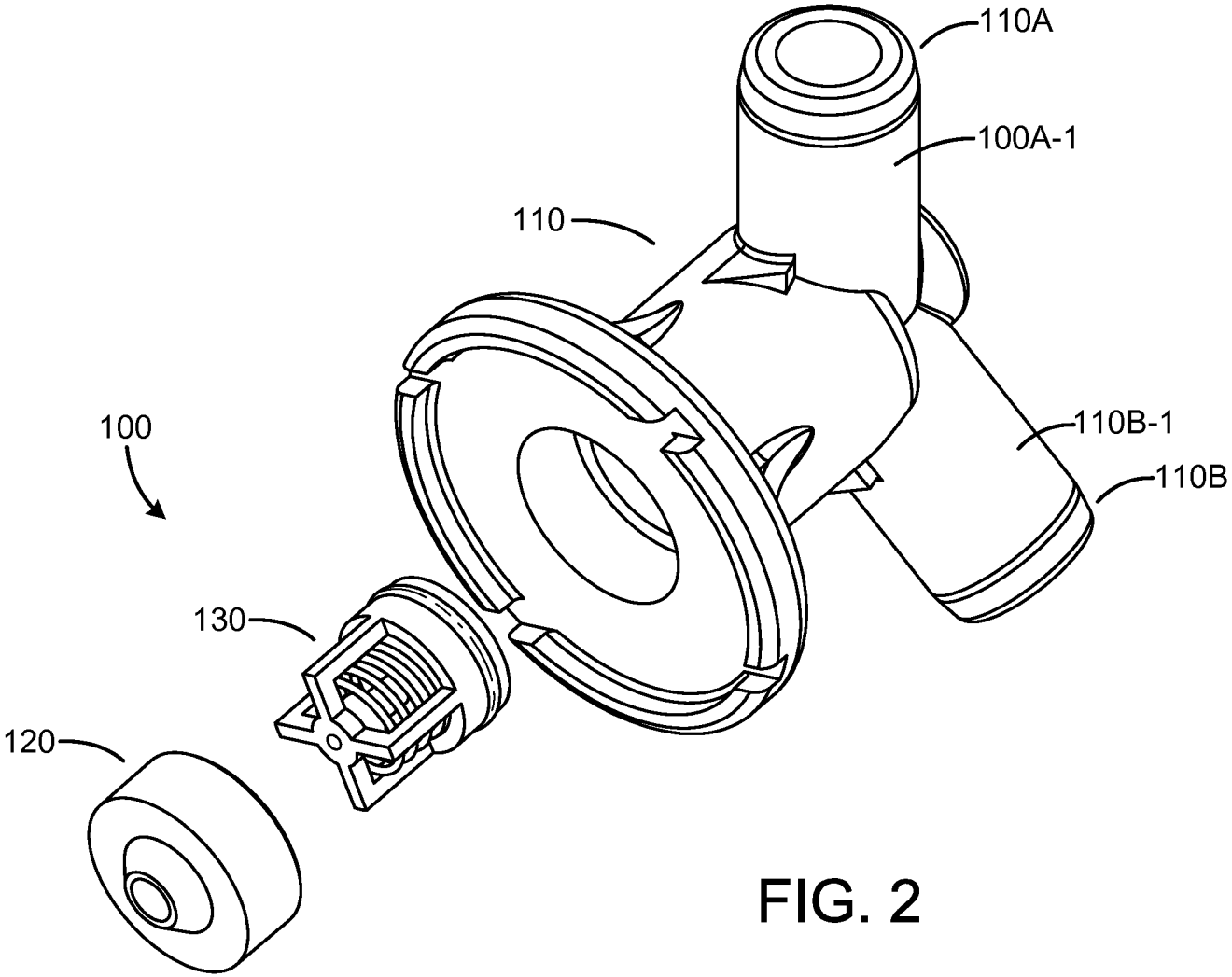
FIG. 2 is an exploded isometric view of another embodiment of an air fitting for a bathing installation.

FIGS. 2-4B illustrate another embodiment of an air jet 100. The jet 100 is similar to jet 50 described above regarding FIGS. 1A-1C, except that, instead of a straight T body, the body 110 has tube connections 110A-1 and 110B-1 which each define a compound angle relative to the center axis 102 of the air jet. As noted above, the angle or compound angle when mounted to the side of the bath tub and pointed upward creates a self-draining effect though each individual jet; when so mounted, a check valve is not required. This permits jets to be placed at different elevations and still drain. Thus, the exemplary embodiment 100 may not include a check valve. FIGS. 2, 3B and 3C illustrate the jet 100 with a check valve 130; FIG. 4B shows the jet 100 without a check valve. The nozzle 120 is seated against the shoulder 114C defined by the abrupt change in diameter of the body opening 114 between body opening region 114A and 114B. The body opening 114 communicates with air passageway 112 through opening 112C.

Figure 3A:
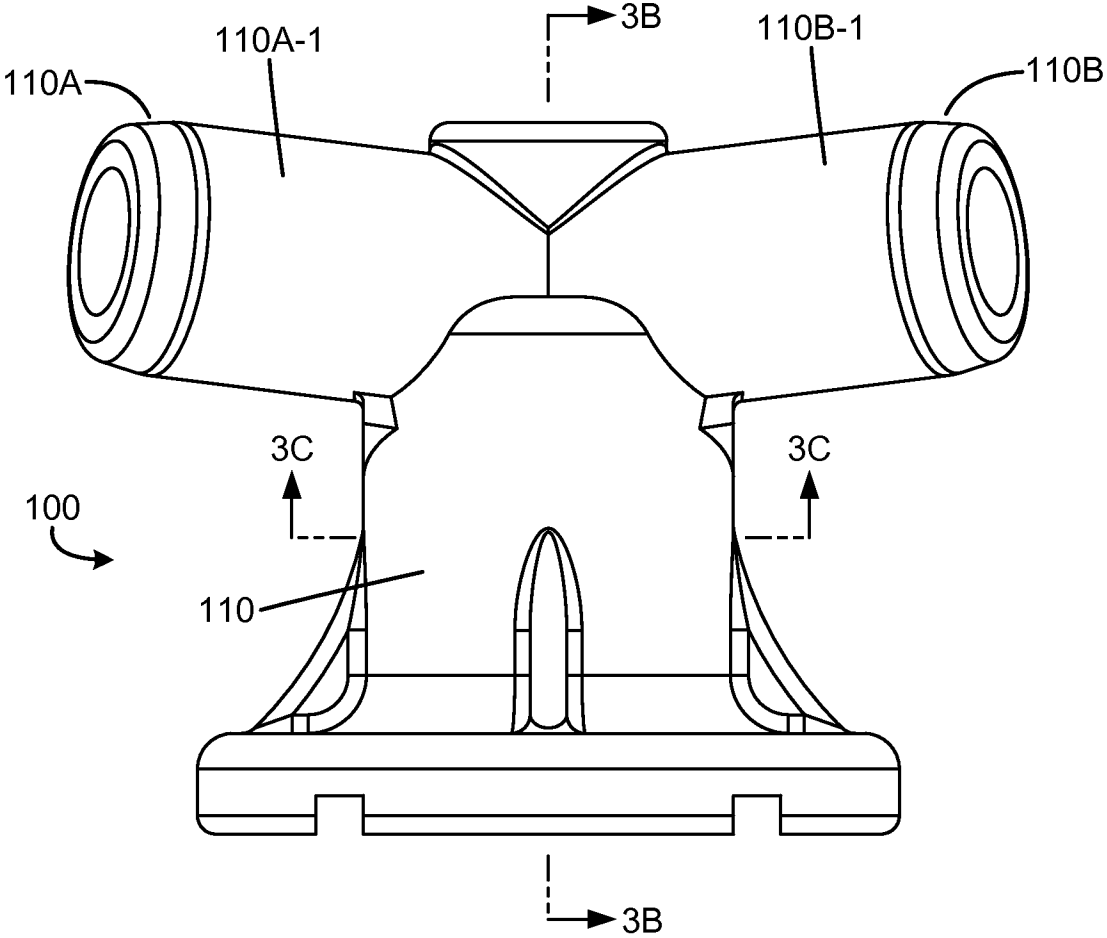
FIG. 3A is a front plan view of the air fitting of FIG. 2.
Figure 3B:
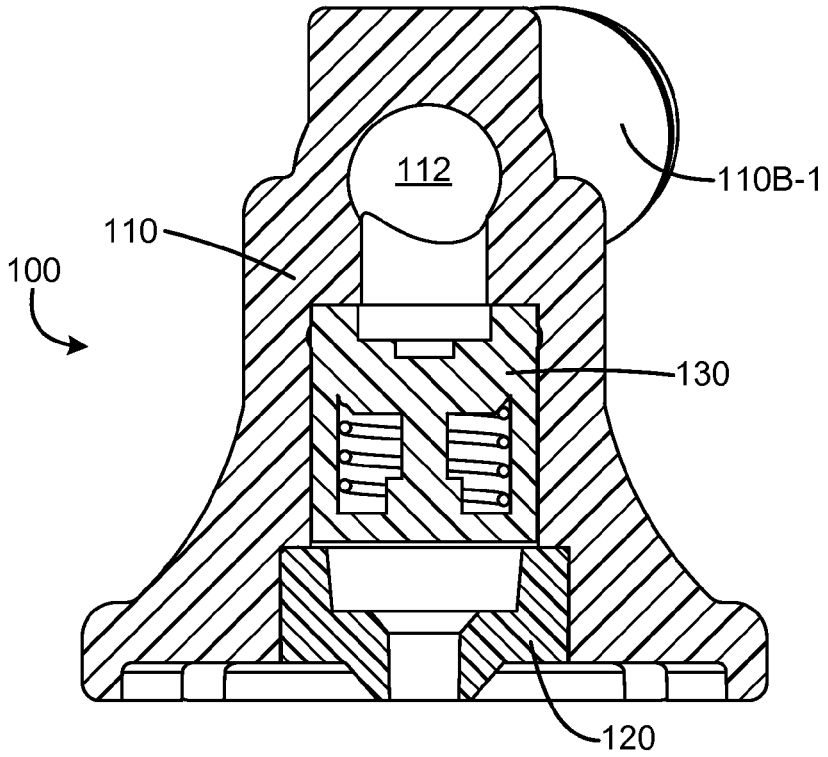
FIG. 3B is a cross-sectional view of the air fitting as shown in FIG. 3A, taken along line 3B-3B.
Figure 3C:
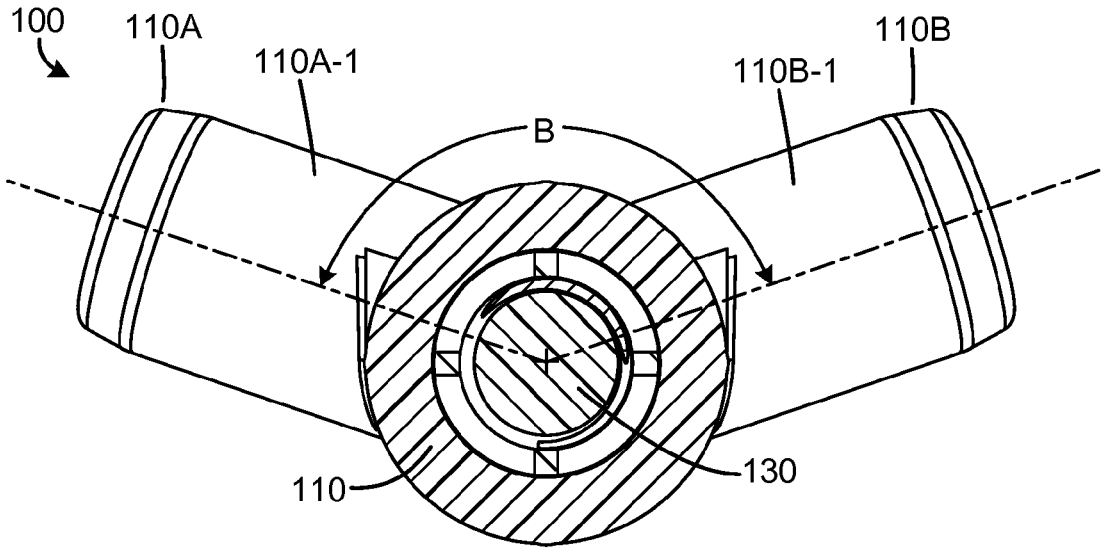
FIG. 3C is a cross-sectional view of the air fitting as shown in FIG. 3A, taken along line 3C-3C.

In this exemplary embodiment, each tube connection projects from the perpendicular to the jet center axis 102 by angle A (FIG. 4B), and the tube connections subtend an angle B from the center axis 102 when viewed from the top or bottom of the jet 100 (FIG. 3C). This facilitates ease of installation by moving the ends of the tube connections further away from the tub wall during installation. For one exemplary embodiment, angle A is about 20 degrees, and angle B is about 140 degrees; other values may be selected according to the requirements of a particular application.

FIG. 4B illustrates an exemplary installation of the air jet 100 on a tub wall portion illustrated as element 10. Typically the tub wall is fabricated of fiberglass, although the air jet may be installed to tubs fabricated of other materials as well. A hole 12 is formed in the tub wall, typically by drilling. The air jet 100 may be secured to the surface 10A of the tub wall by a liquid adhesive 140, such as an epoxy, placed in the shallow recess 116C of the flange portion 116. The slots 116D formed in the peripheral lip 116B allow excess adhesive to escape, and the jet is secured in place once the adhesive has cured.

Figure 5A:
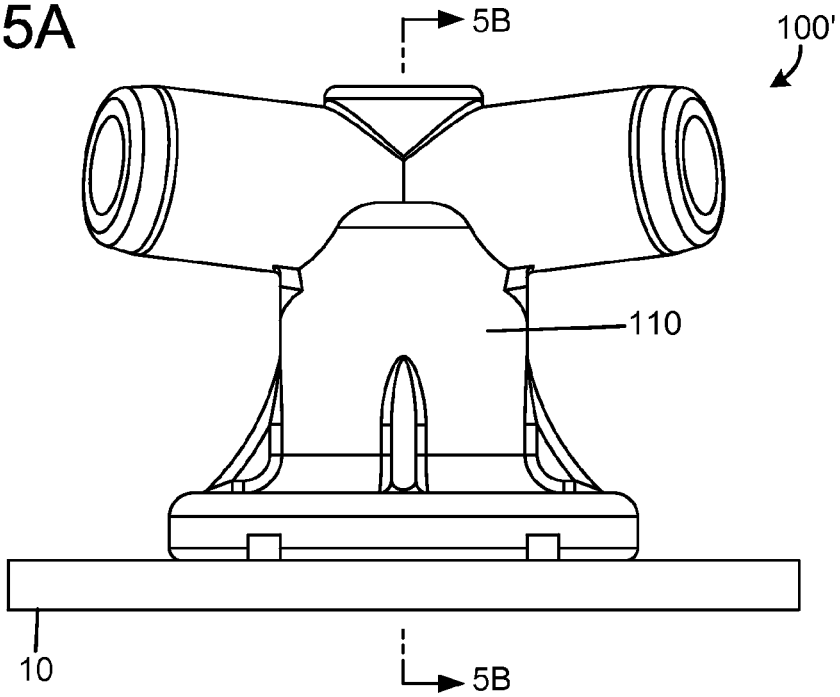
FIG. 5A is a front plan view of another alternative embodiment of an air fitting for a bathing installation, positioned on a representation of a tub wall of the bathing installation.
Figure 5B:
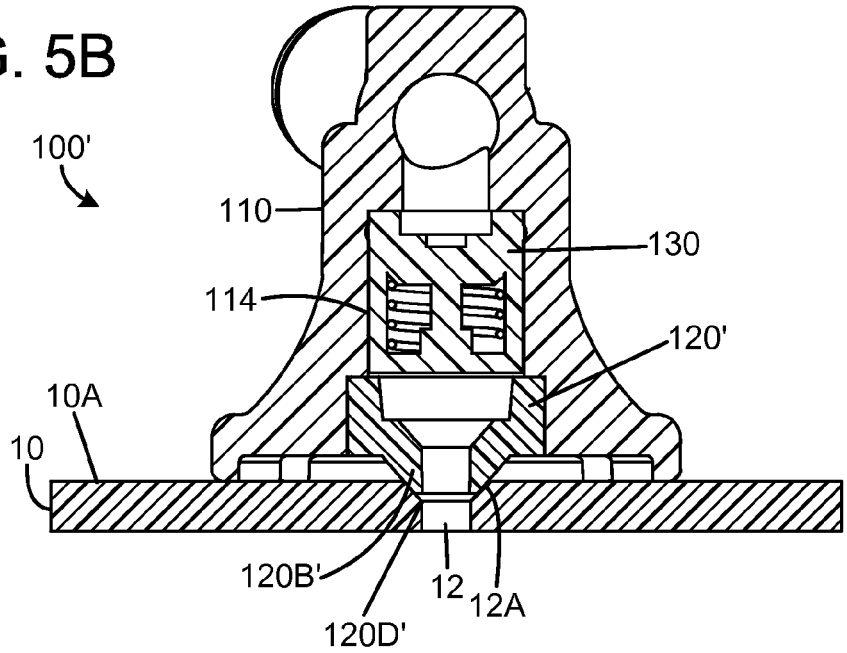
FIG. 5B is a cross-sectional view of the air fitting and tub wall of FIG. 5A, taken along line 5B-5B.
Figure 5C:
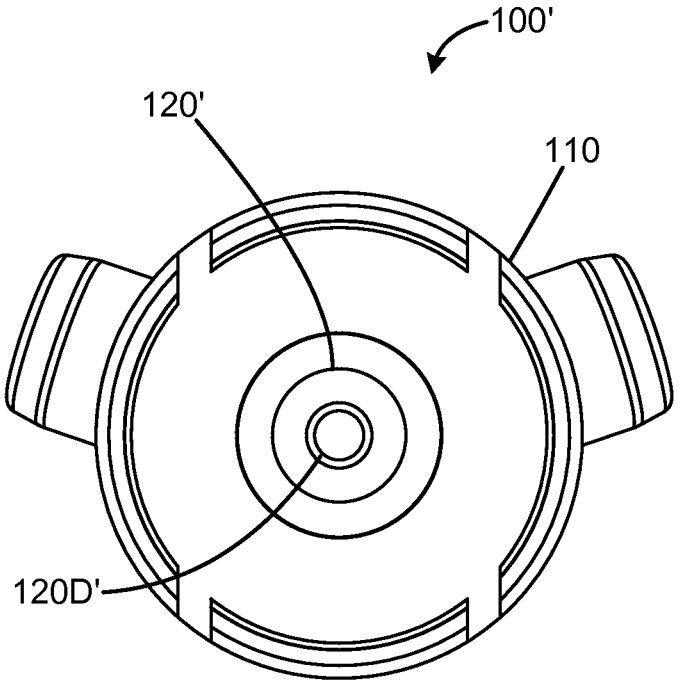
FIG. 5C is a bottom view of the air fitting of FIGS. 5A and 5B.

The center axis 102 of the jet body is aligned with the hole 12 formed in the tub wall. A guide pin pushed through the hole 12 in the tub may be used to align the nozzle orifice 120D of the nozzle with the hole 12. The nozzle tip 120B face surface contacts the tub shell surface surrounding the hole 12 to prevent liquid adhesive from flowing into the shell hole 12; a guide pin when used during installation also prevents adhesive flow into the hole 12. In an exemplary embodiment, the tub wall may be fiberglass, with a thickness of ⅛ (0.125) inch, and the hole 12 drilled or formed in the wall has a diameter of 0.125 inch. The nozzle orifice 120D may in this example also have a diameter of 0.125 inch. In this embodiment, the diameter of the front flange portion is 1.16 inches, and the length of the body portion, i. e. the distance the body portion protrudes from the wall when attached to the wall, is 1.125 inches. Thus, for this exemplary embodiment, the flange diameter and the body portion length are both less than about 1.25 inches FIGS. 5A-5C show another embodiment of an air jet 100' which is similar to air jet 100 of FIGS. 2-4B, and includes a check valve 130, positioned within the body opening 114, and the nozzle 120' includes a somewhat longer nozzle tip portion 120B' such that the nozzle tip surface 120D' is positioned into the beveled portion 12A of the hole 12 formed in the tub wall 10. This embodiment provides a self-aligning feature, since the installer guides the jet into position over the hole 12, until the extended tip enters the wall hole, confirmed by tactile sensing. This extended nozzle tip also provides a cutoff surface when fitted into the beveled or chamfered portion of the hole, helping to prevent the adhesive (not shown in FIG. 5B) from entering the nozzle orifice or tub wall hole and fouling the installation. The extended nozzle tip, for an example of a 0.125 inch thick shell or tub wall, and a 0.125 inch diameter hole formed in the tub, may extend 0.030 inch into the chamfer portion 12A of the hole 12 to provide a pilot on the nozzle. The extended nozzle tip subtends an angle, which in an exemplary embodiment is 82 degrees, although other angles may be suitable for the purpose.

Figure 6B:
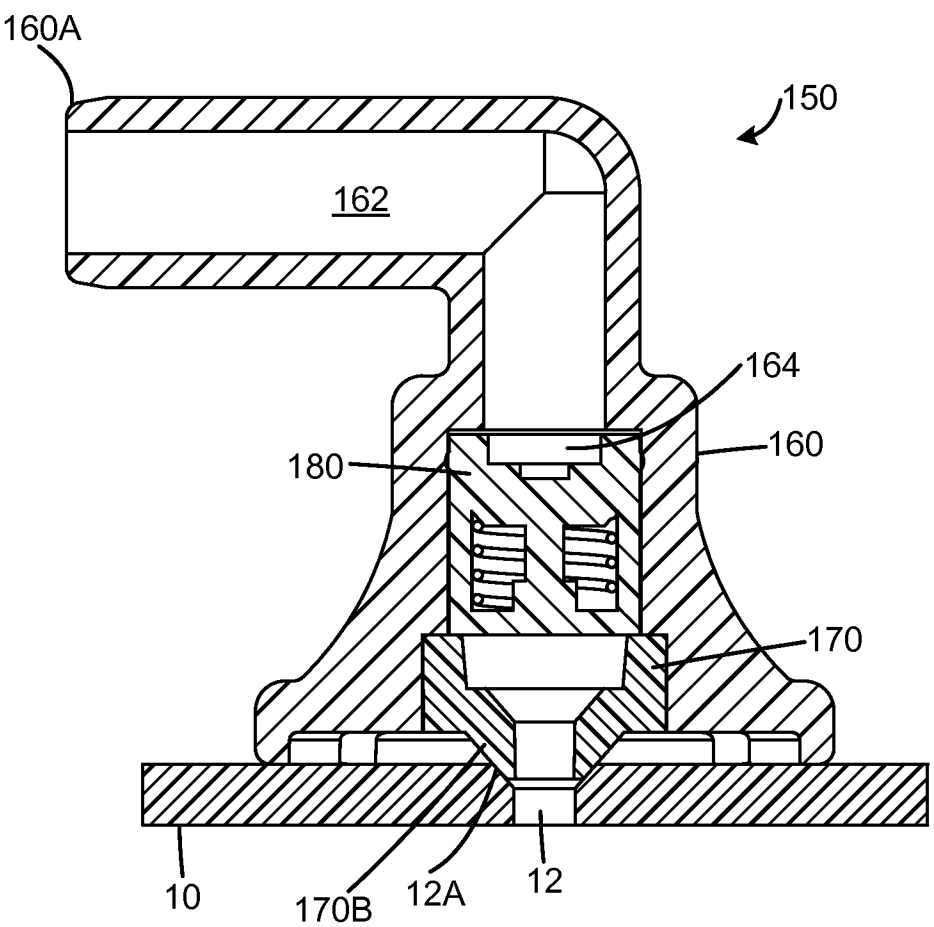
FIG. 6B is a cross-section view of the air fitting of FIG. 6A, positioned on a representation of a tub wall.
Figure 6A:
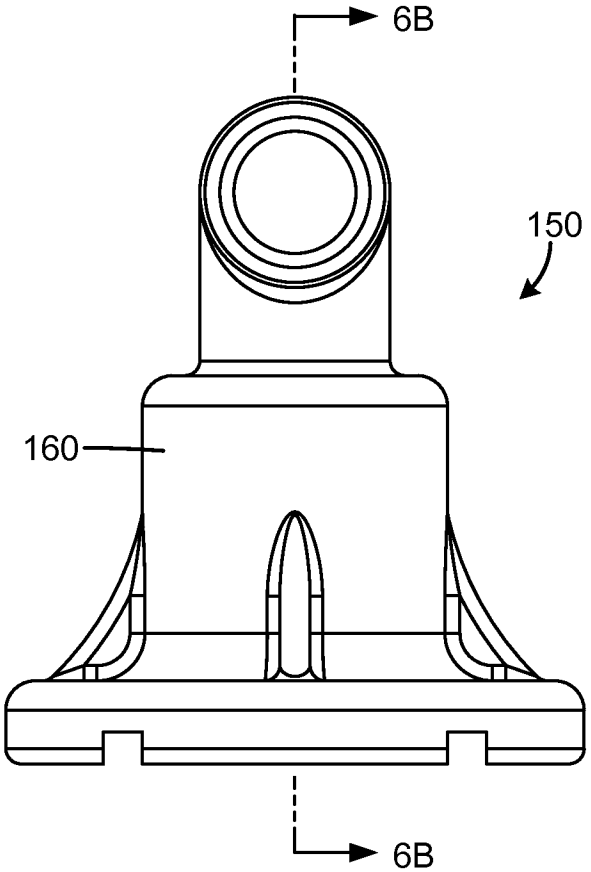
FIG. 6A is a front plan view of another alternate embodiment of an air fitting for a bathing installation.
Figure 6C:
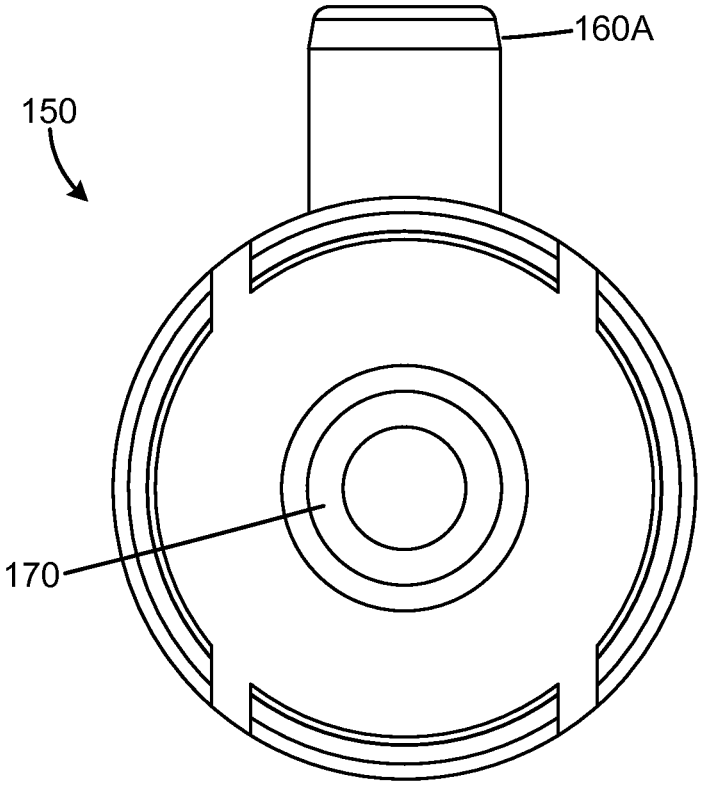
FIG. 6C is a bottom view of the air fitting embodiment of FIG. 6A.

FIGS. 6A-6C illustrate another embodiment of an air jet 150, in which the body provides an L-shaped hose connection. This jet is suited for use as the last jet in a string of jets, for example. The jet body 160 thus provides a single connection 160A, with air passageway 162 communicating between the connection 160A and the body opening 164. A check valve 180 is positioned in the opening 164, and may be the same as check valve 80 regarding the embodiment of FIGS. 1A-1C. The nozzle 170 may be the same as nozzle 120' of the embodiment of FIGS. 5A-5C, with the extended nozzle tip 170B. Alternatively, a nozzle with the nozzle tip configuration of nozzle 70 may alternatively be employed. FIG. 6B shows the air jet 150 installed on a wall 10 with orifice 12 having a beveled or chamfered portion 12A. The adhesive used to attach the air jet to the wall is not shown in FIG. 6B.

Figure 7:
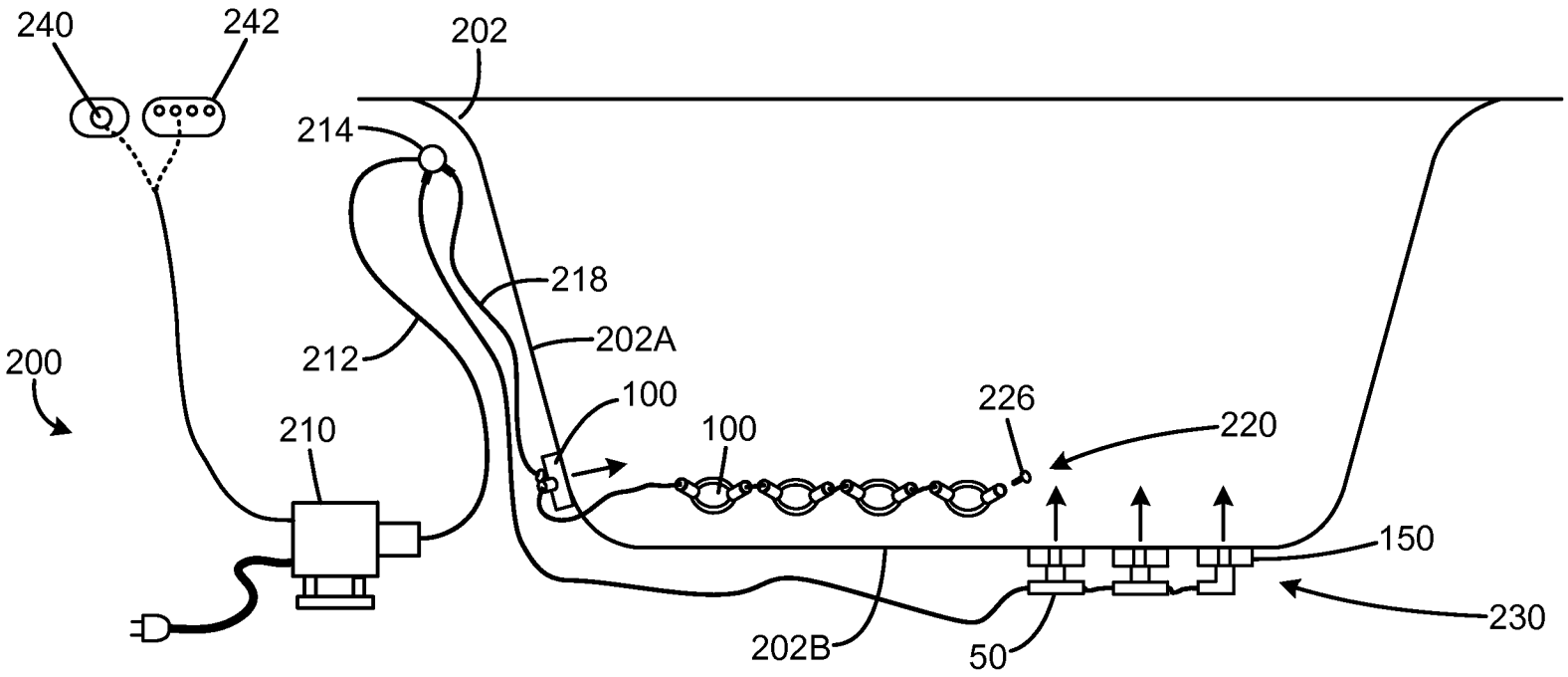
FIG. 7 is a schematic representation of a bathing installation tub with an air blower system and a set of air fittings connected to the blower system.

FIG. 7 schematically illustrates an exemplary embodiment of an air massage system 200, which includes a source 210 for positive air pressure that is sent through a plumbing system and hose to arrive at the air jet hose connection and passes thought the air jet exiting through the orifice and then through the hole in the tub shell into the bath. If an internal check valve is in the air jet, the air pressure must be sufficient open the check valve to have the air exit the orifice and through the wall in the side or bottom of the tub. In this embodiment, the plumbing system includes a flexible tube or hose 212 having one end connected to an outlet portion of the source 210, and a second end connected to a manifold 214. The manifold 214 distributes the pressurized air to multiple circuits of air jets, although for many installations, a single circuit of air jets may be employed, e.g. a lateral circuit of jets in the tub side wall, or a bottom circuit of jets in the bottom of the tub. The manifold may service multiple lateral circuits or multiple bottom circuits, depending on the air pressure and number of jets which can be serviced from a single pump or manifold output. In this exemplary embodiment, the first jet circuit 220 is a lateral circuit, and is connected to an outlet port on the manifold 214 by a hose or conduit tube 218, and the air jets include several (five are shown, but more or fewer jets could be employed) air jets with the compound angular configuration of jet 100. The last jet in the circuit 220 has its unused connection port plugged with plug 226. The jets in the circuit 220 are mounted to the side wall 202A of the bathing installation tub 202. The air jets in the string 220 may be the V-configuration jet of the configuration of jet 100, and may or may not include one-way flow valves, due to the V shape of the jet, facilitating self-draining when the tub is emptied of water.

The air jets of the second circuit 230 are mounted in the bottom wall 202B of the tub 202. The jets in this exemplary circuit may be of the straight T configuration of jet 50, with the terminal jet in the string an L-shaped jet having the configuration of jet 150. The jets in the tub bottom will typically include a one-way valve to prevent water from entering the air jet circuit air passageways.

The source 210 of system 200 may be controlled by an air switch 240, or by an electronic control panel 242, by way of example only.

Figure 8:
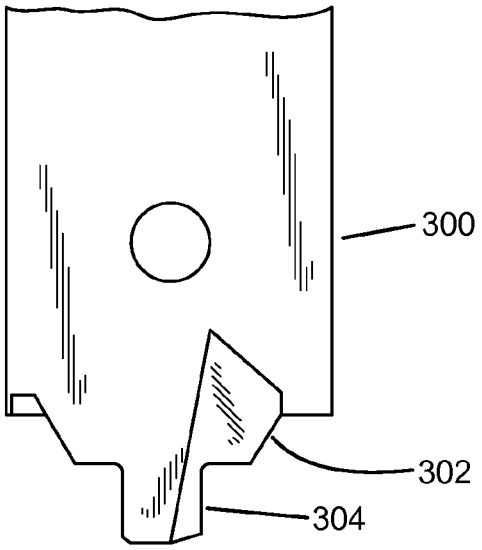
FIG. 8 illustrates an exemplary drill bit configured to form holes in a tub wall of a bathing installation for installation of an air fitting.
Figure 9:
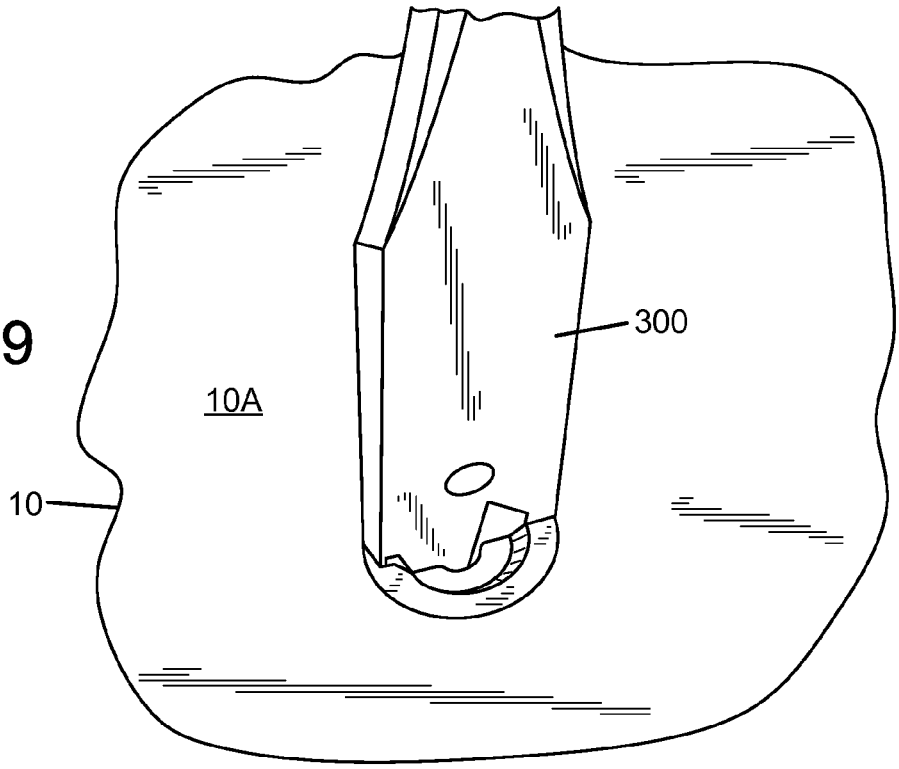
FIG. 9 illustrates the drill bit of FIG. 8 in operation to form an air fitting hole in a tub wall.

The beveled or chamfered hole 12 may be formed in the tub wall by a special drill bit such as bit 300 illustrated in FIGS. 8 and 9. The hole 12 may first be formed by use of a conventional drill bit of the size of the hole 12, e.g. 0.125 inch, drilling from the tub inside surface through the tub wall. Now working from the opposite, exterior side of the tub wall, the bit 300 may be used to form the chamfer 12A, with bit angled portion 302 forming the bevel to a predetermined depth. As an example, the tub wall 10 may have a thickness of 0.125 inch, and the chamfered edges of the nozzle tip may subtend an angle of 82 degrees. For the case in which the nozzle has an extended nozzle tip portion to extend past the bottom edge of the lip portion of the jet body, the nozzle tip may extend into the wall opening by 0.030 inch or so, to provide a pilot or alignment function, as described above. The drill bit 300 may be configured to provide a chamfer depth of 0.050 inch, for this example.

The air jet is well suited for use in bathing installations such as whirlpool baths or bath tubs, with air massage systems.

Figure 10B:
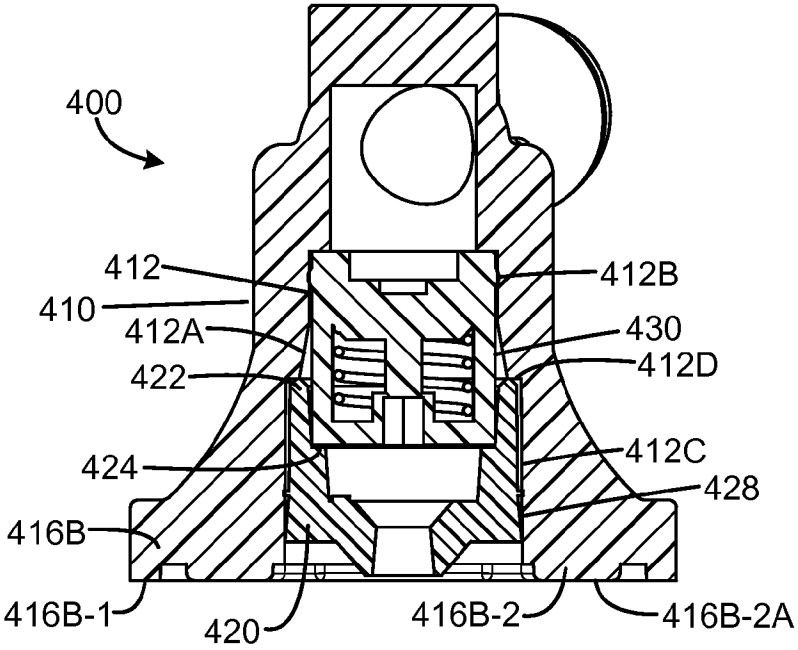
FIGS. 10A and 10B illustrate a further alternate embodiment of an air jet, in which protrusions are formed in the flange recess to reduce the amount of adhesive for installation.
Figure 10A:
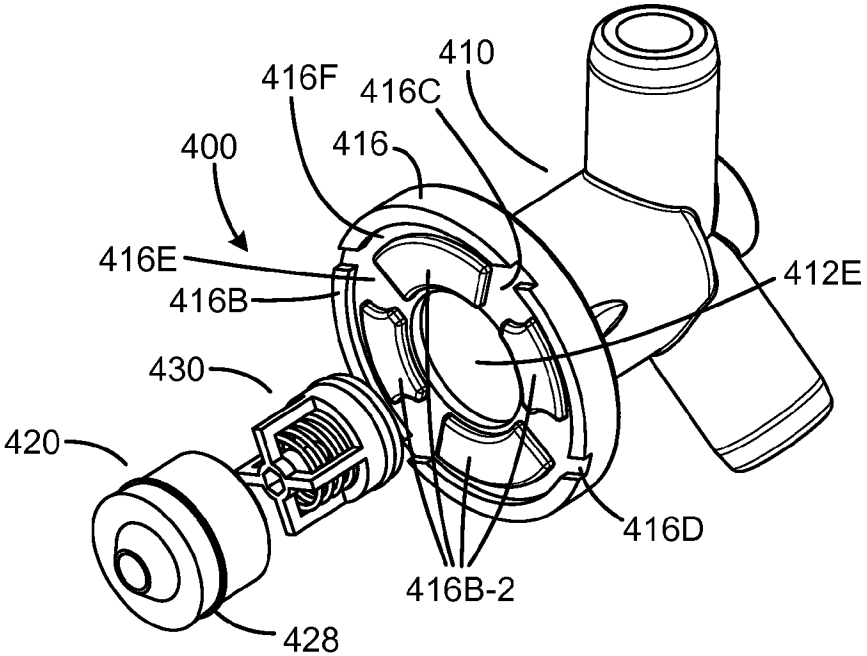

A further embodiment of an air jet 400 is illustrated in FIGS. 10A and 10B. The air jet includes a jet body 410, a nozzle structure 420 and a valve 430. The air jet 400 is generally similar to the air jet 100 of FIG. 2, with some differences. The nozzle structure 420 is deeper than the nozzle 120 of air jet 100, and accepts the end portion of the valve structure 430 into the interior facing end 422 of the nozzle structure 420. The nozzle structure 420 has a shoulder surface 424 against which the end portion of the valve structure 430 is fitted. The interior passageway 412 of the body 410 has a tapered end 412A of slightly enlarged diameter relative to the upper portion 412B of the passageway. The lower portion 412C of the passageway is enlarged relative to portion 412B to form a shoulder 412D, forming a stop surface for the nozzle structure 420. A bump 428 is formed about the outer perimeter of the nozzle structure to aid in fluid sealing and create an interference fit with the passageway 412. The lower portion 412C of the passageway may be tapered from an opening diameter at the nozzle tip to a slightly larger diameter adjacent the shoulder 412D. This taper facilitates insertion of the valve end into the nozzle end, and also the interference fit of the nozzle within the body passageway.

Figure 11B:
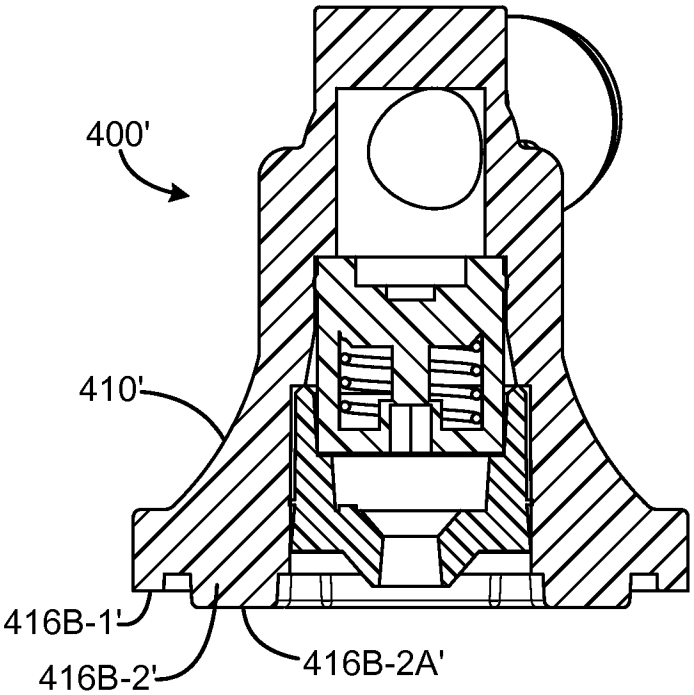
FIGS. 11A and 11B illustrate a further alternate embodiment of an air jet, in which protrusions are formed in the flange recess and extend beyond the edge of the peripheral lip.
Figure 11A:
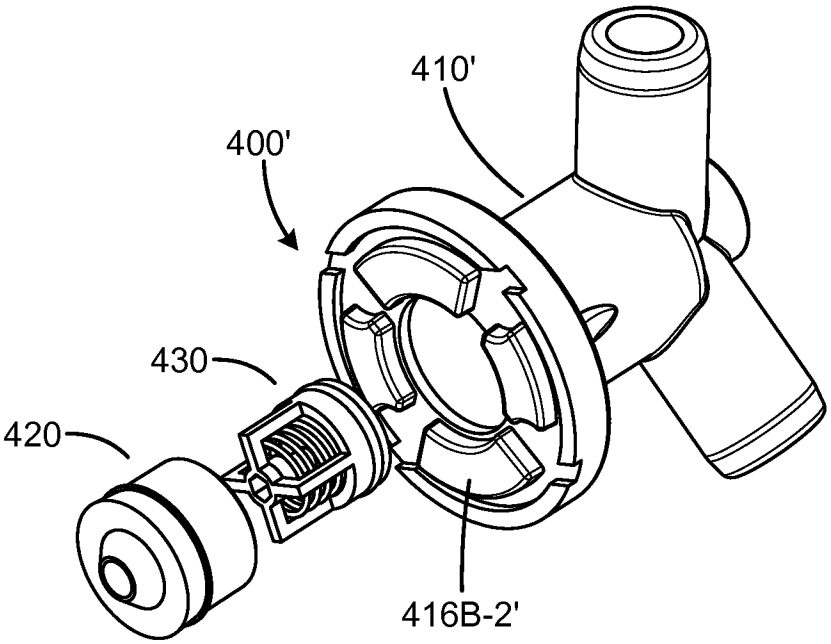

Another feature of the air jet 400 is that the interior recess of the body 410 is not flat, but rather has protrusions or lands 416B-2 extending from the recess surface 416E, generally surrounding the opening 412E in the body 410. The lands are discontinuous in this exemplary embodiment, with open regions or gaps 416C defined between the lands, and in general alignment with the slots 416D formed in the peripheral lip 416B of the flange 416. Open regions or gaps 416F also are defined between the outer edges of the lands 416B-2 and the peripheral lip 416B. The lands 416B-2 reduce the open volume of the recess defined by surface 416E and lip 416B, and thus will reduce the amount of adhesive used to mount the air jet 400 to a tub wall. The adhesive may reside in and fill the open regions 416C and 416F within the recess, and excess adhesive will flow out the slots 416D. The reduction in the amount of adhesive will provide a cost reduction and may, in combination with the lands, improve the quality of adhesion of the air jet to the tub wall. In one exemplary embodiment, the lands 416B-2 reduce the open volume of the recess by about 35%, but in other embodiments, the size of the lands and reduction in volume may be more or less than 35%, e.g., 20% to 70% or more. Also, the shape of the land structures 416B-2 may differ from that illustrated in FIGS. 10A-10B. For example, the land structure could form a "C" shaped protrusion; other shapes and configurations may alternatively be employed, In the exemplary embodiment of FIGS. 10A and 10B, the surfaces 416B-2A of the lands 416B-2 are generally flush with the surface 416B-1 of the exterior lip 416B of the flange of the air jet 400. In other embodiments, the lands may not protrude as much from the recess surface 416E, or may protrude somewhat further from the recess surface. FIGS. 11A and 11B illustrate an exemplary air jet 400' with a nozzle structure 420 and valve 430 as in the embodiment of FIGS. 10A and 10B, but with a body structure 410' in which the lands 416B-2' protrude further from the recess and extend past the flange lip surface 416B-1'. In this embodiment, the surfaces 416B-2A' protrude further, and are not flush with the edge surface 416B-1'. The surfaces may protrude past the edge surface, by some distance, e.g. on the order of 0.005 inch to 0.100 inch or more.

FIGS. 12-18 illustrate embodiments of new water jets for bathing installations, incorporating low profile features, which may by attached to vessel walls in a manner similar to that described above regarding the air jets. In an exemplary embodiment, the water jets mount to the outside surface of the bath shell or tub. The exemplary embodiments may include one or more of the following features:

1. The jets are hidden from view from the perspective of one using the bathing installation, such as a whirlpool bath.
2. The jets are stealthy, a user may not know the bathing installation is a whirlpool until the water pump is turned on and the streams of water appear from the jets, shooting into the water.
3. The jet is delivered as a single piece to install for the whirlpool tub manufacturer.
4. A similar installation technique may be used for the water jet as described above for the air jet. The technique includes drilling the jet hole through the tub wall, insert a guide pin through the tub hole so that it protrudes from the back of the wall and in front of the jet, place epoxy or adhesive on the face of the jet, use the pin as a guide by inserting the pin into the jet nozzle, and push the jet with epoxy against the tub wall. Remove the pin, leaving the jet nozzle aligned with the tub wall hole.
5. The water jet may be formed of different configurations for the water supply ports, including straight (horizontal), V-shaped, compound V-shaped, or any combination with a single water and air connection.
6. The water jet can provide a very close fit to the back of the tub wall, allowing installation in tight spaces.
7. The water jet may be low profile to allow installation on double wall "island" tubs, i.e. in the space between the outer wall and the inner wall. Conventional jets are too large (protrude too far from the inner wall.)
8. Embodiments of the water jet may be installed with smaller inner diameter (ID) water lines such as ¾" ID. Conventional jets typically use 1" Schedule 40 pipe.

9. Fittings may be added to optionally blow any water remaining in the lines out. An air source such as a blower (typically a vacuum cleaner motor and device to use the discharge air side of motor).

10. A key to blowing out the lines is using hose with small ID (smaller volume of air to displace compared to standard 1" schedule 40 pipe plumbing).

11. The water jet can be designed with the raised bumps or lands on the jet face which displaces glue to reduce its usage.

12. With the V or compound V shape, the jets are self-draining and do not need to be installed in a straight line angle either towards the pump or away from the pump to get the jet plumbing to drain.

13. Embodiments of the water jet can be installed on solid surface, i.e. thick-walled, tubs.

Figure 13A:
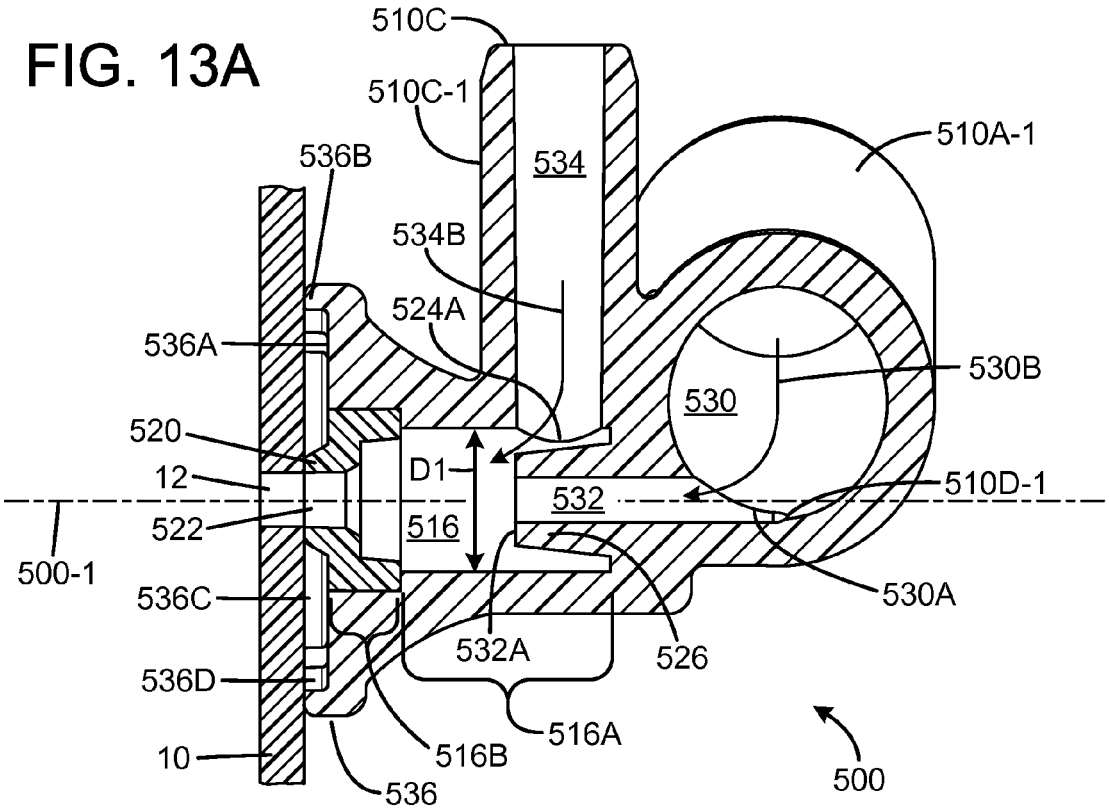
FIG. 13A is a cross-sectional view of the fitting of FIG. 13, taken along line 13A-13A of FIG. 13, and showing the fitting attached to a wall of a bathing installation tub.
Figure 14:
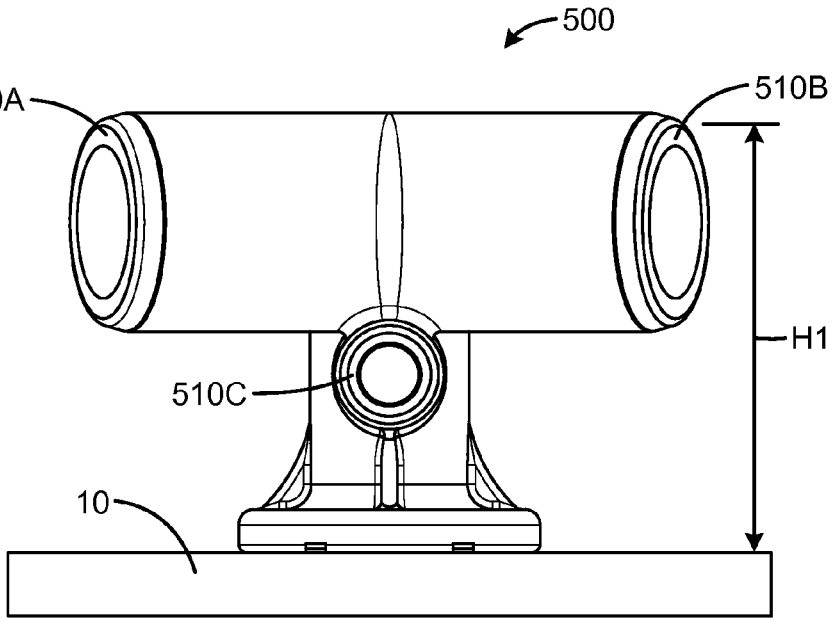
FIG. 14 is a top view of the fitting of claim 12, attached to a wall of a bathing installation tub.

An exemplary embodiment of a water jet 500 is illustrated in FIGS. 12-14. The embodiment includes a unitary jet body 510 and a nozzle 520 which is configured to press-fit into an opening portion 516B of the jet body. Both structures, the jet body and the nozzle, may be fabricated from a plastic material such as PVC, and fabricated by injection molding processes. The particular embodiment 500 has two water ports 510A and 510B, at the distal ends of hollow tube portions 510A-1 and 510B-1, with a water passageway 530 defined through the tube portions. The tube portions are angled, in a V-shaped configuration in this exemplary embodiment, which meet at joint 510D. The water ports may be connected in a daisy chain arrangement, to a pump supplying water in a recirculation water flow path.

The jet 500 further includes an air inlet port 510C, at a distal end of hollow tube portion 510C-1. An open passageway 534 is defined in the hollow tube portion 510C-1. The jet 500 is configured to be installed to a bathing installation tub wall 10, with the hollow tube portion 510C-1 in a vertical orientation. A tube may be connected to the air inlet port 510C, with a distal end above the jet, and in communication with the ambient air, or with a check valve or air control device.

The internal configuration of the jet 500 is illustrated in further detail in the cross-sectional view of FIG. 13A. This view is taken along line 13A-13A of FIG. 13. The jet is configured to produce a stream of water exiting from the nozzle orifice which is entrained with air bubbles, created by a venture effect. Water under pressure from inlet passageway 530 passes into narrow passageway 532 in internal boss 526, terminating at 532A in a plenum chamber 516. Air passageway 534 is oriented transversely with respect to the narrow passageway 532, intersects passageway 532 at 530A, and terminates at opening 532A in the plenum 516 adjacent the boss 526. In an exemplary embodiment, the diameter of the passageway 532 is 0.187 inch, and the diameter of the larger air passageway 534 is 0.25 inch. Water passes from passageway 530 into narrow passageway 532 as indicated by arrow 530B. Water exiting passageway 532 at 532A enters plenum 516, and draws ambient air from passageway 534 into the plenum, mixing air bubbles with the water. The water and entrained air bubbles exit the fitting 500 through nozzle opening 522 of the nozzle 520.

In an exemplary embodiment, the fitting 500 has a height H1 (FIG. 14) of 1.75 inches. This reduced height jet allows the fitting to be used in double wall tub installations, in which the fittings are installed in the space between the inside wall and the exterior wall. In this exemplary embodiment, the water ports 510A and 510B are sized to fit to smaller diameter water lines, e.g. water lines having a ¾ inch inner diameter (ID), and the air inlet port 510C is sized to file to an air line having a ⅜ inch ID.

The water jet body 510 includes a flange portion 536, defining a recessed mount surface 536A defined inside a peripheral lip 536B at a mounting surface side of the jet body, and forming a shallow recess 536C. Slots 536D are defined in the peripheral lip 536B, and allow excess adhesive applied to the mount surface 536A within the recess 536C to escape during installation on a bathing installation tub wall 10 (FIG. 14). Typically the adhesive is a liquid or gel such as an epoxy when applied and then cures to a hardened state.

The water jet body 510 and nozzle 520 may each be fabricated as injection molded parts, from a plastic material, e.g. PVC or ABS. In an exemplary embodiment, the water jet 500 is delivered to a customer/user as an assembled device, i.e. with the nozzle assembled to the jet body, facilitating installation by reducing or eliminating the need to assemble the air jet before installation.

As previously noted, the water jet 500 may be installed to the surface of the tub wall or panel 10 using a similar installation technique as described above for the air jet. The technique includes drilling the jet hole 12 through the tub wall 10, inserting a guide pin through the tub hole so that it protrudes from the back of the wall and in front of the jet to be installed, placing epoxy or adhesive on the face (surface 536A) of the jet, using the pin as a guide by inserting the pin into the jet nozzle opening 522, and pushing the jet with epoxy against the tub wall. The pin is then removed, leaving the jet nozzle opening aligned with the tub wall hole.

The water ports 510A, 510B define an angle which may be the same or similar to the angle B described above regarding the air jet of FIG. 3C, or a different angle such as a compound angle including the angle A of FIG. 4B. The water jet 500 will typically be installed to a tub wall 10, with the air port 510C oriented vertically and upwardly. In other applications, the jet fitting may be installed to the tub in other orientations, e.g. with the air port directed in a downwardly direction.

The intersection of the narrow passageway 532 with the water inlet passageway 530 at 510D-1 is preferably tangential to the wall defining the passageway 530. This ensures that any water remaining in the passageway will drain by force of gravity from the passageway 530 into the plenum cavity 516 when the jet is not in operation. When the bathing installation tub is drained, water in the jet will drain to the interior of the tub, and then through the tub drain. Any remaining water can be expelled by forcing air through the water lines, as described below.

Figure 15:
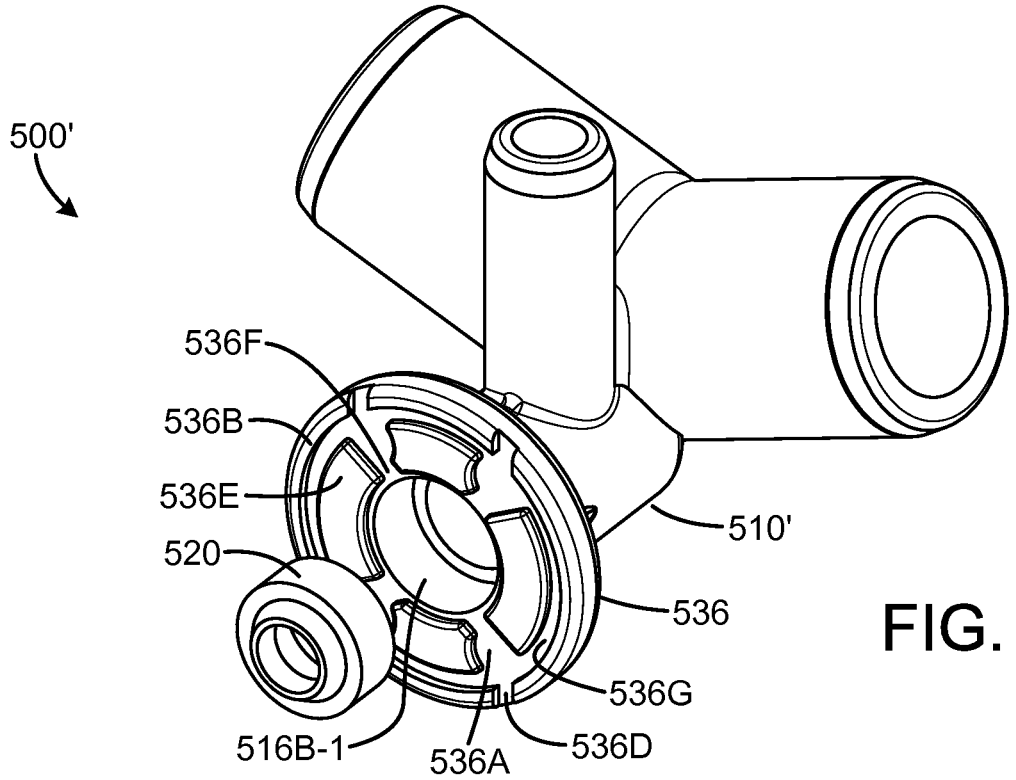
FIG. 15 is an isometric view of an alternate embodiment of a fitting for a bathing installation, providing a water jet feature.
Figure 17:
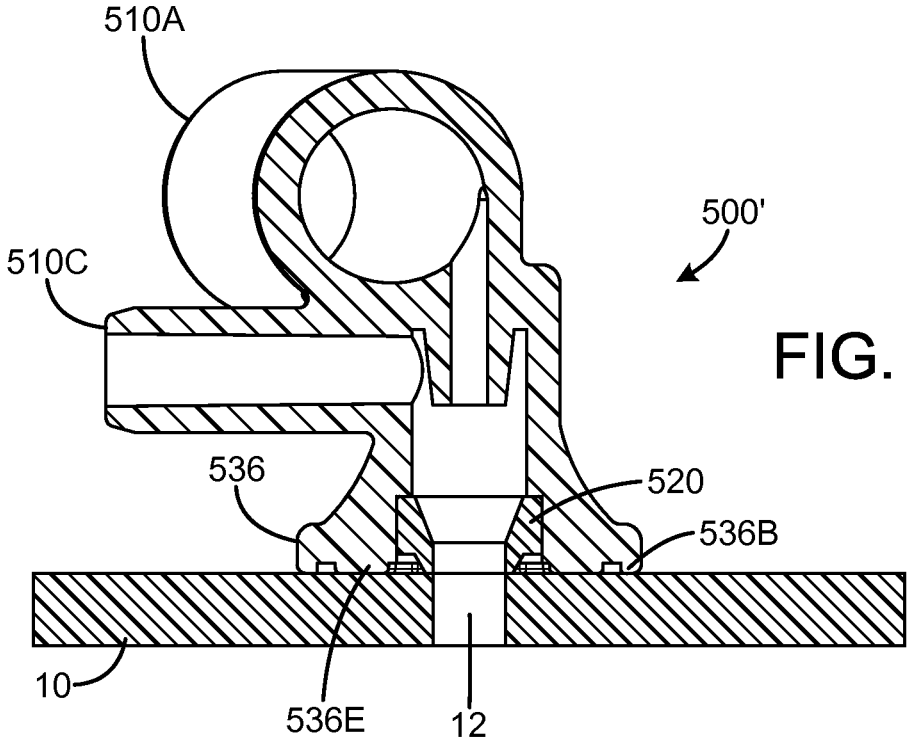
FIG. 17 is a cross-sectional view of the fitting of FIGS. 15-16A, showing the fitting installed to a tub of a bathing installation, with an air port arranged in a generally upright orientation.

A further embodiment of a water jet 500' is illustrated in FIGS. 15-17. The water jet includes a jet body 510', and a nozzle structure 520. The water jet 500' is generally similar to the water jet 500 of FIGS. 12-14. A difference is that the interior recess surface 536A of the body 510' is not flat between the peripheral lip 536B, but rather has protrusions or lands 536E extending from the recess surface, generally surrounding the opening 516B-1 in the body 510'. The lands are discontinuous in this exemplary embodiment, with open regions or gaps 536F defined between the lands, and in general alignment with the slots 536D formed in the peripheral lip 536B of the flange 536. Open regions or gaps 536G also are defined between the outer edges of the lands 536E and the peripheral lip 536B. The lands 536E reduce the open volume of the recess defined by surface 536A and lip 536B, and thus will reduce the amount of adhesive used to mount the water jet 500' to a tub wall. The adhesive may reside in and fill the open regions 536F and 536G within the recess, and excess adhesive will flow out the slots 536D. The reduction in the amount of adhesive will provide a cost reduction and may, in combination with the lands, improve the quality of adhesion of the air jet to the tub wall. In one exemplary embodiment, the lands 536E reduce the open volume of the recess by about 35%, but in other embodiments, the size of the lands and reduction in volume may be more or less than 35%, e.g., 20% to 70% or more. Also, the shape of the land structures 536E may differ from that illustrated in FIGS. 15-17. For example, the land structure could form a "C" shaped protrusion; other shapes and configurations may alternatively be employed, In the exemplary embodiment of FIGS. 15-17, the surfaces of the lands 536E are generally flush with the surface of the exterior lip 5366B of the flange of the air jet 400. In other embodiments, the lands may not protrude as much from the recess surface 536A, or may protrude somewhat further from the recess surface.

Figure 18:
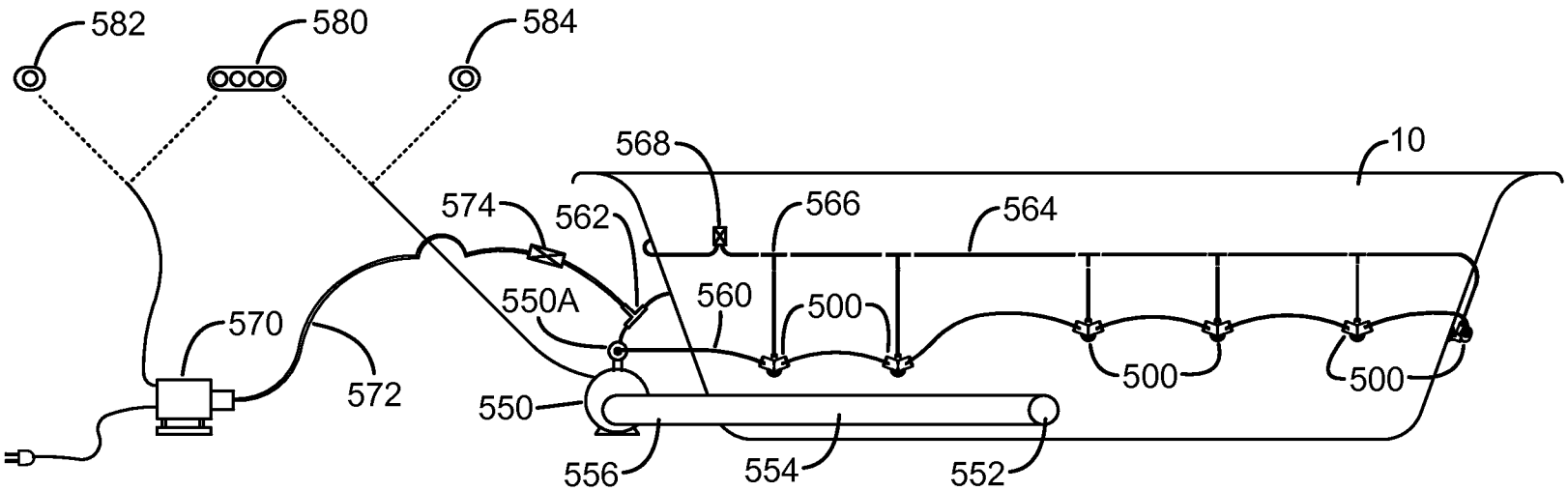
FIG. 18 illustrates an exemplary bathing installation employing water jets for a whirlpool bath with a tub in accordance with aspects of the invention.

FIG. 18 illustrates an exemplary bathing installation employing water jets 500, in this case for a whirlpool bath with a tub 10. Water in the tub can be drained through a drain (not shown in FIG. 18). In use, the tub is filled to some level by the user, after closing the drain. Water jets 500 are installed to the tub 10 on the exterior tub surface, as described above. The jets in this embodiment are daisy-chained together in a recirculating water flow path by tubing sections 560, with the end points of the daisy chain connected to a water pump 550. A suction fitting 552 is passed through an opening in the tub adjacent the bottom of the tub, and is connected to the inlet of the water pump 550 by a tubing 554. The outlet of the water pump is connected to a T fitting 550A, also connected to the end points of the daisy chain. When the pump is operated, e.g. under control of the electronic bathing installation controller 580, water is drawn from the suction fitting 552 from the tub 10, through tubing 554 to the pump 550. The pump forces water under pressure into the daisy chained connection of water jets 500, which jet water out each jet nozzle into the tub. Typically the tub is filled with water above the level of the jets in the tub. The installation further includes air tubing system 564, connected to each air port of the air jets and through a series of T connections 568 to the ambient air through a check valve 568.

The jets 500 may have opposed water ports as described above regarding FIG. 12, or an L shaped configuration with a single water port, to be used at the end of a water flow path. Alternatively, a dual port jet can be used at the end of the water flow path, with a cap closing one of the water ports.

A further feature of the bathing installation of FIG. 18 is the air blower system which can be actuated, preferably after the tub has been drained, to blow water out of the recirculating water flow path. An air blower 570 is connected to the tubing system 560 by a T connector 562, through air line 572 and check valve 574. When the blower is activated, e.g. by the electronic system controller 580, after the tub is drained of water, air is blown through the water supply lines and out the jet nozzle opening 522. Alternatively, the pump 550 and blower 570 may be actuated manually through air buttons 584, 582 connected to air-actuated switches built into the pump and blower. Even though the jets 500 are self-draining, any residual droplets of water tend to be blown out the jets, and the water lines dried. It is preferred that water lines of smaller ID, such as ¾ inch, instead of conventional 1 inch ID pipe, enables a smaller volume of air to displace the water, and thus a smaller capacity blower is needed in comparison to what would otherwise be needed if 1 inch OD pipe was used. The flow of air from the blower will also pass through the pump, the tubing 554 and out the suction fitting 552, tending to blow water out from these parts of the system, and drying them. The check valve 574 prevents water from backflowing into the blower during pump operation. The check valve 568 in some applications prevents air from being blown out the air inlet port during blower operation. A check valve 568 may be omitted in other embodiments.

The electronic controller 580 may be programmed in applications to carry out the air blower function automatically after the pump is turned off. In this case, after the pump has been turned off by the controller, the air blower will be actuated in a programmed sequence, for a period of time, to push water out of the recirculating water path including the water lines, jets, pump and suction fitting.

Although the foregoing has been a description and illustration of specific embodiments of the subject matter, various modifications and changes thereto can be made by persons skilled in the art without departing from the scope and spirit of the invention.

What is claimed is:

1. A jet fitting for a bathing vessel for holding bathing water, comprising:

a body portion defining a hollow main body portion having an interior opening, and a connection portion having a passageway in communication with the interior opening, the connection portion including at least one connection port for attachment to a hose carrying pressurized water, and a flange portion defining a recessed mount surface inside a peripheral lip surrounding a recess, the peripheral lip at a mounting surface side of the body portion and defining a lip edge configured to contact a wall of the vessel, with at least one open region defined in the peripheral lip to allow excess adhesive applied to the mount surface within the recess to escape during installation of the air jet to the wall of the vessel;

wherein the body portion is a unitary one-piece structure without requiring separate multi-piece portions assembled with annular seals or threads;

a nozzle member constructed as a separate structure from the unitary one-piece structure of the body portion, the nozzle member configured to be fitted into the interior opening from the mounting surface side of the body portion and seated against a shoulder surface within the interior opening defined by the body portion, the nozzle member having a nozzle orifice, the nozzle orifice configured for concentric mounting relative to a single tub hole formed in the wall of the vessel to allow air or water to pass from the connection port through the central opening and through the nozzle orifice into the tub hole and into the interior of the vessel, the nozzle member configured to be in contact with the wall of the vessel surrounding the hole during the installation to prevent flow of adhesive into the hole during the installation, and wherein the nozzle member is fixed in position within the separate unitary structure of the body portion during use; and wherein no fitting attachment features are visible from the interior of the vessel after installation of the body portion to the exterior surface of the vessel wall.

2. The fitting of claim 1, wherein the connection portion is connected to a water supply source.

3. The fitting of claim 1, wherein the connection portion includes a first connection portion with a first connection port and a second connection portion with a second connection port in a general T-shaped configuration and define a "V" shaped configuration relative to each other, and wherein the configuration provides a self-draining effect when the fitting is mounted to the side of the vessel with the first and second connection portions disposed in upward directions.

4. The fitting of claim 1, wherein the unitary one-piece structure is an injection-molded part fabricated from a plastic material.

5. A jet fitting for a bathing vessel for holding bathing water, comprising:

a body portion defining a hollow main body portion having an interior plenum, at least one water port in fluid communication with an inlet water passageway and configured for connection to a water supply, a jet water passageway communicating between the inlet water passageway and the interior plenum at a distal jet water passageway end, an air inlet port in communication with an air passageway, the air passageway having a distal end in communication with the interior plenum, the air inlet port configured for attachment to a hose connected to ambient air, and a flange portion defining a recessed mount surface inside a peripheral lip surrounding a recess, the peripheral lip at a mounting surface side of the body portion and defining a lip edge configured to contact a wall of the vessel, with at least one open region defined in the peripheral lip to allow excess adhesive applied to the mount surface within the recess to escape during installation of the jet fitting to the wall of the vessel;

wherein the body portion is a unitary one-piece structure without requiring separate multi-piece portions assembled with annular seals or threads;

a nozzle member constructed as a separate structure from the unitary one-piece structure of the body portion, the nozzle member configured to be fitted into the interior plenum from the mounting surface side of the body portion and seated against a shoulder surface within the interior opening defined by the body portion, the nozzle member having a nozzle orifice configured for concentric mounting relative to a single vessel hole formed in the wall of the vessel to allow water and entrained air from the at least one water port and the air inlet port to pass into the vessel hole and into the interior of the vessel, the nozzle member configured to be in contact with the wall of the vessel surrounding the hole during the installation to prevent flow of adhesive into the hole during the installation, and wherein the nozzle member is fixed in position within the separate unitary structure of the body portion during use;

wherein no fitting attachment features are visible from the interior of the vessel after installation of the body portion to the exterior surface of the vessel wall; and the jet is configured to produce a stream of water exiting from the nozzle orifice which is entrained with air bubbles, created by a venturi effect wherein water passing from the inlet water passageway through the jet waterway and into the interior plenum draws ambient air from the air passageway into the plenum, mixing air bubbles with the water, the water and entrained air bubbles exiting the jet through the nozzle orifice into the vessel.

6. The fitting of claim 5, wherein the at least one water port includes first and second water ports arranged in a "V" shaped configuration relative to each other, and wherein the configuration provides a self-draining effect when the fitting is mounted to the side of the vessel with the first and second water ports oriented in upward directions.

7. The fitting of claim 6, wherein the first and second water ports are disposed at distal ends of respective first and second hollow tube portions which meet at a joint, with the inlet water passageway defined through the first and second tube portions.

8. The fitting of claim 7, wherein the air passageway is defined in a third hollow tube portion, extending transversely with respect to a center axis of the fitting, and wherein the fitting is configured to be installed to a bathing installation tub wall with the third hollow tube portion in a vertical orientation.

9. The fitting of claim 5, wherein the nozzle member is press fit into the interior plenum.

10. The fitting of claim 5, wherein the flange portion has a diameter of less than about 1.25 inch, and the main body portion has a height of less than about 2.0 inches.

11. The fitting of claim 5, wherein the unitary one-piece structure is an injection-molded part fabricated from a plastic material.

12. The fitting of claim 5, wherein said jet water passageway is transverse to the inlet water passageway and tangentially intersects a wall defining the inlet water passageway.

13. The fitting of claim 5, wherein the body portion further includes at least one protrusion between the peripheral lip and the interior opening to reduce the volume of the recess and the amount of adhesive for installation of the fitting to the wall of the vessel.

14. A bathing installation comprising:

a tub for holding water during use;

a plurality of water jets connected in a recirculating water flow path to direct water from jet nozzles into the tub interior in a jetting mode, wherein the plurality of water lets are daisy chained together in the recirculating water flow path by tubing sections;

a pump connected in the recirculating water flow path to pump water through the recirculation water flow path, the path including a suction fitting in the tub wall to draw water from the tub and to the pump during pump operation;

an air blower connected to the recirculating water flow path through a valve, and configured to blow air through the jets, the recirculating water flow path, the pump and the suction fitting with the pump turned off to expel water from the jets, the recirculating water flow path, the pump and the suction fitting during a blower mode.

15. The bathing installation of claim 14, wherein each of said plurality of water jets comprises:

a body portion defining a hollow main body portion having an interior plenum, at least one water port in fluid communication with an inlet water passageway and configured for connection to a water supply, a jet water passageway communicating between the inlet water passageway and the interior plenum at a distal jet water passageway end, an air inlet port in communication with an air passageway, the air passageway having a distal end in communication with the interior plenum, the air inlet port configured for attachment to a hose connected to ambient air, and a flange portion defining a recessed mount surface inside a peripheral lip surrounding a recess, the peripheral lip at a mounting surface side of the body portion and defining a lip edge configured to contact a wall of the vessel, with at least one open region defined in the peripheral lip to allow excess adhesive applied to the mount surface within the recess to escape during installation of the jet fitting to the wall of the vessel;

wherein the body portion is a unitary one-piece structure without requiring separate multi-piece portions assembled with annular seals or threads;

a nozzle member constructed as a separate structure from the unitary one-piece structure of the body portion, the nozzle member configured to be fitted into the interior plenum from the mounting surface side of the body portion and seated against a shoulder surface within the interior opening defined by the body portion, the nozzle member having a nozzle orifice configured for concentric mounting relative to a single vessel hole formed in the wall of the vessel to allow water and entrained air from the at least one water port and the air inlet port to pass into the vessel hole and into the interior of the vessel, the nozzle member configured to be in contact with the wall of the vessel surrounding the hole during the installation to prevent flow of adhesive into the hole during the installation, and wherein the nozzle member is fixed in position within the separate unitary structure of the body portion during use;

wherein no fitting attachment features are visible from the interior of the vessel after installation of the body portion to the exterior surface of the vessel wall; and the jet is configured to produce a stream of water exiting from the nozzle orifice which is entrained with air bubbles, created by a venturi effect wherein water passing from the inlet water passageway through the jet waterway and into the interior plenum draws ambient air from the air passageway into the plenum, mixing air bubbles with the water, the water and entrained air bubbles exiting the jet through the nozzle orifice into the vessel.

16. The bathing installation of claim 15, wherein the at least one water port includes first and second water ports arranged in a "V" shaped configuration relative to each other, and wherein the configuration provides a self-draining effect when the fitting is mounted to the side of the vessel with the first and second water ports oriented in upward directions.

17. The bathing installation of claim 14, wherein the tubing sections have an inner diameter smaller than 1 inch.

18. The bathing installation of claim 17, wherein the inner diameter of the tubing sections is ¾ inch.

19. A bathing installation comprising:

a tub for holding water during use;

a plurality of water jets connected in a recirculating water flow path to direct water from jet nozzles into the tub interior in a jetting mode;

a pump connected in the recirculating water flow path to pump water through the recirculation water flow path, the path including a suction fitting in the tub wall to draw water from the tub and to the pump during pump operation;

an air blower connected to the recirculating water flow path through a valve, and configured to blow air through the jets, the recirculating water flow path, the pump and the suction fitting with the pump turned off to expel water from the jets, the recirculating water flow path, the pump and the suction fitting during a blower mode; and wherein each of said plurality of water jets comprises:

a body portion defining a hollow main body portion having an interior plenum, at least one water port in fluid communication with an inlet water passageway and configured for connection to a water supply, a jet water passageway communicating between the inlet water passageway and the interior plenum at a distal jet water passageway end, an air inlet port in communication with an air passageway, the air passageway having a distal end in communication with the interior plenum, the air inlet port configured for attachment to a hose connected to ambient air, and a flange portion defining a recessed mount surface inside a peripheral lip surrounding a recess, the peripheral lip at a mounting surface side of the body portion and defining a lip edge configured to contact a wall of the vessel, with at least one open region defined in the peripheral lip to allow excess adhesive applied to the mount surface within the recess to escape during installation of the jet fitting to the wall of the vessel;

wherein the body portion is a unitary one-piece structure without requiring separate multi-piece portions assembled with annular seals or threads;

a nozzle member constructed as a separate structure from the unitary one-piece structure of the body portion, the nozzle member configured to be fitted into the interior plenum from the mounting surface side of the body portion and seated against a shoulder surface within the interior opening defined by the body portion, the nozzle member having a nozzle orifice configured for concentric mounting relative to a single vessel hole formed in the wall of the vessel to allow water and entrained air from the at least one water port and the air inlet port to pass into the vessel hole and into the interior of the vessel, the nozzle member configured to be in contact with the wall of the vessel surrounding the hole during the installation to prevent flow of adhesive into the hole during the installation, and wherein the nozzle member is fixed in position within the separate unitary structure of the body portion during use;

wherein no fitting attachment features are visible from the interior of the vessel after installation of the body portion to the exterior surface of the vessel wall; and the jet is configured to produce a stream of water exiting from the nozzle orifice which is entrained with air bubbles, created by a venturi effect wherein water passing from the inlet water passageway through the jet waterway and into the interior plenum draws ambient air from the air passageway into the plenum, mixing air bubbles with the water, the water and entrained air bubbles exiting the jet through the nozzle orifice into the vessel.

20. A bathing installation comprising:

a tub for holding water during use;

a plurality of water jets connected in a recirculating water flow path to direct water from jet nozzles into the tub interior in a jetting mode, wherein the recirculating water flow path comprises a plurality of tubing sections;

a pump connected in the recirculating water flow path to pump water through the recirculation water flow path, the path including a suction fitting in the tub wall to draw water from the tub and to the pump during pump operation;

an air blower connected to the recirculating water flow path through a check valve, and configured to blow air through the jets, the recirculating water flow path, the pump and the suction fitting with the pump turned off to expel water from the jets, from the recirculating water flow path, from the pump and from the suction fitting during a blower mode;

the check valve configured to prevent water from back-flowing into the blower during pump operation.

* * * * *